US009974362B2

(12) United States Patent
Baggen et al.

(10) Patent No.: US 9,974,362 B2
(45) Date of Patent: May 22, 2018

(54) ASSEMBLY FOR COLORING ARTICLES AND METHOD OF COLORING

(71) Applicant: NIKE, Inc., Beaverton, OR (US)

(72) Inventors: Jared S. Baggen, Portland, OR (US); Anna Schoborg, Beaverton, OR (US); Feng Ye, Guangzhou (CN)

(73) Assignee: NIKE, Inc.., Beaverton, OR (US)

( * ) Notice: Subject to any disclaimer, the term of this patent is extended or adjusted under 35 U.S.C. 154(b) by 79 days.

(21) Appl. No.: 14/199,381

(22) Filed: Mar. 6, 2014

(65) Prior Publication Data

US 2014/0255612 A1 Sep. 11, 2014

Related U.S. Application Data

(63) Continuation-in-part of application No. 13/791,643, filed on Mar. 8, 2013, now Pat. No. 9,668,538.

(51) Int. Cl.

| | |
|---|---|
| ***A43D 95/06*** | (2006.01) |
| ***A43B 1/00*** | (2006.01) |
| ***A43B 13/00*** | (2006.01) |
| ***B05C 3/09*** | (2006.01) |
| ***B05C 3/20*** | (2006.01) |
| ***B05C 13/02*** | (2006.01) |

(52) U.S. Cl.
CPC ..... *A43D 95/06* (2013.01); *A43B 1/0027* (2013.01); *A43B 13/00* (2013.01); *B05C 3/09* (2013.01); *B05C 13/02* (2013.01); *B05C 3/20* (2013.01)

(58) Field of Classification Search
CPC ..... A43D 95/06; A43B 1/0027; A43B 13/00; B05C 3/09; B05C 3/20; B05C 13/02
See application file for complete search history.

(56) References Cited

U.S. PATENT DOCUMENTS

| | | | | |
|---|---|---|---|---|
| 3,670,698 | A | 6/1972 | Joosten | |
| 3,938,952 | A | 2/1976 | McNeill | |
| 3,951,599 | A | 4/1976 | Davis et al. | |
| 4,183,156 | A | 1/1980 | Rudy | |
| 4,219,945 | A | 9/1980 | Rudy | |
| 4,307,521 | A | 12/1981 | Inohara et al. | |
| 4,321,721 | A | 3/1982 | Painter et al. | |
| 4,936,029 | A | 6/1990 | Rudy | |
| 4,965,099 | A | 10/1990 | Bornhorst | |
| 5,042,176 | A | 8/1991 | Rudy | |
| 5,096,457 | A | 3/1992 | Nakagawa et al. | |
| 5,713,141 | A | 2/1998 | Mitchell et al. | |
| 5,935,273 | A | 8/1999 | Kruger et al. | |
| 5,952,065 | A | 9/1999 | Mitchell et al. | |
| 6,013,340 | A | 1/2000 | Bonk et al. | |
| 6,082,025 | A | 7/2000 | Bonk et al. | |
| 6,094,947 | A * | 8/2000 | Scatizzi | D06B 5/12 68/148 |
| 6,127,026 | A | 10/2000 | Bonk et al. | |
| 6,203,868 | B1 | 3/2001 | Bonk et al. | |
| 6,299,817 | B1 | 10/2001 | Parkinson | |
| 6,321,465 | B1 | 11/2001 | Bonk et al. | |
| 6,581,418 | B1 * | 6/2003 | Kim | D06B 1/10 118/227 |
| 6,733,543 | B2 | 5/2004 | Pyles et al. | |
| 6,749,646 | B2 | 6/2004 | Pyles et al. | |
| 7,003,900 | B2 | 2/2006 | Trommer | |
| 7,611,547 | B2 | 11/2009 | Bracken et al. | |
| 7,655,054 | B2 | 2/2010 | Weathersbee | |
| 7,841,105 | B2 | 11/2010 | Wyszynski et al. | |
| 7,906,199 | B2 | 3/2011 | Rearick et al. | |
| 7,966,750 | B2 | 6/2011 | Schindler et al. | |
| 8,127,469 | B2 | 3/2012 | Keenan et al. | |
| 2002/0050077 | A1 | 5/2002 | Wang et al. | |
| 2004/0041292 | A1 | 3/2004 | Chen et al. | |
| 2005/0125916 | A1 | 6/2005 | Pyles et al. | |
| 2005/0217150 | A1 | 10/2005 | Hoffer et al. | |
| 2006/0105128 | A1 | 5/2006 | Zeng | |
| 2007/0045898 | A1 | 3/2007 | Yang | |
| 2007/0175576 | A1 | 8/2007 | Dojan et al. | |
| 2007/0294841 | A1 | 12/2007 | Thullen et al. | |
| 2008/0066342 | A1 | 3/2008 | Park | |
| 2008/0184595 | A1 | 8/2008 | Schindler et al. | |
| 2009/0089942 | A1 | 4/2009 | Pyles et al. | |
| 2009/0178301 | A1 | 7/2009 | Dojan et al. | |
| 2010/0122476 | A1 | 5/2010 | Le et al. | |
| 2011/0232135 | A1 | 9/2011 | Dean et al. | |
| 2011/0283560 | A1 | 11/2011 | Portzline et al. | |

(Continued)

FOREIGN PATENT DOCUMENTS

| | | |
|---|---|---|
| CN | 1446056 A | 10/2003 |
| CN | 1894464 A | 1/2007 |

(Continued)

OTHER PUBLICATIONS

Derwent 1990-356732, Mathieu 1990.*
USPTO, Final Office Action for U.S. Appl. No. 13/791,643 dated May 21, 2015.
International Search Report and Written Opinion dated Dec. 11, 2014 in PCT/US2014/021703.
International Search Report and Written Opinion dated Sep. 3, 2014 in PCT/US2014/021716.
International Search Report and Written Opinion dated Dec. 16, 2014 in PCT/US2014/021729.

(Continued)

*Primary Examiner* — Amina S Khan

(74) *Attorney, Agent, or Firm* — Honigman Miller Schwartz and Cohn LLP; Matthew H. Szalach; Jonathan P. O'Brien

(57) ABSTRACT

A coloring system includes an assembly for retaining articles to be colored and an actuator for moving the assembly. The assembly can be translated horizontally, raised and lowered and rotated by the actuator. The coloring system may include a fluid control system that allows gas to be removed from a container of the assembly while the container is immersed in a liquid coloring agent.

18 Claims, 35 Drawing Sheets

(56) References Cited

U.S. PATENT DOCUMENTS

| | | | |
|---|---|---|---|
| 2014/0250609 | A1 | 9/2014 | Tutmark et al. |
| 2014/0250611 | A1 | 9/2014 | Schoborg et al. |
| 2014/0256468 | A1 | 9/2014 | Tutmark et al. |

FOREIGN PATENT DOCUMENTS

| | | | | |
|---|---|---|---|---|
| CN | 101082156 | A | | 12/2007 |
| CN | 101165266 | A | | 4/2008 |
| CN | 101195952 | A | | 6/2008 |
| CN | 101408002 | A | | 4/2009 |
| CN | 101578054 | A | | 11/2009 |
| CN | 101905208 | A | | 12/2010 |
| DE | 1 685 433 | | | 7/1971 |
| EP | 2 050 866 | | | 4/2009 |
| FR | 1 547 431 | | | 11/1968 |
| FR | 2 682 130 | | | 4/1993 |
| GB | 1555116 | | * | 11/1979 |
| JP | S5095372 | U | | 8/1975 |
| JP | 6-240587 | A | | 8/1994 |
| JP | 2000-158560 | A | | 6/2000 |
| JP | 2004285515 | A | | 10/2004 |
| JP | 2010032845 | A | | 2/2010 |
| JP | 2012113954 | A | | 6/2012 |
| WO | 91/15973 | A1 | | 10/1991 |
| WO | 2014/138569 | | | 9/2014 |
| WO | 2014/138573 | | | 9/2014 |
| WO | 2014/138576 | | | 9/2014 |
| WO | 2014/138621 | | | 9/2014 |

OTHER PUBLICATIONS

International Search Report and Written Opinion dated Dec. 15, 2014 in PCT/US2014/021890.
Office Action dated Nov. 4, 2014 in U.S. Appl. No. 13/791,643.
Taiwan Intellectual Property Office (R.O.C.), Office Action for Taiwan Patent Application No. 103108311, dated Aug. 5, 2015.
U.S. Appl. No. 13/786,031, filed Mar. 5, 2013.
U.S. Appl. No. 13/786,043, filed Mar. 5, 2013.
U.S. Appl. No. 13/786,056, filed Mar. 5, 2013.
State Intellectual Property Office (P.R.C.), Chinese Office Action for Application No. 201480013070.9, dated Jul. 25, 2016.
USPTO, Non-Final Office Action for U.S. Appl. No. 13/791,643, dated Jul. 1, 2016.
Reebok Sole Trainer, Jan. 16, 2008.
Nike Air Trainer SC, May 2011.
USPTO, Non-Final Office Action for U.S. Appl. No. 14/199,422, dated Feb. 11, 2016.
State Intellectual Property Office, Chinese Office Action for Application No. 201480013036.1, dated Nov. 29, 2016.
State Intellectual Property Office, Chinese Office Action for Application No. 201480013030.4, dated Dec. 26, 2016.
State Intellectual Property Office (PRC), Office Action for CN Application No. 201480013030.4, dated Sep. 30, 2017.
European Patent Office, Office Action for EP Application No. 14724536.9, dated Oct. 5, 2017.
Japan Patent Office, Notice of Reasons for Rejection for JP Application No. 2015-561710, dated Aug. 15, 2016.
Canadian Intellectual Property Office, Examination Report for CA Application No. 2,903,491, dated Sep. 14, 2016.

* cited by examiner

ASSEMBLY FOR COLORING ARTICLES AND METHOD OF COLORING

CROSS-REFERENCE TO RELATED APPLICATIONS

This application is a Continuation-In-Part of U.S. Patent Publication Number 2014/0250610, currently U.S. application Ser. No. 13/791,643, entitled "System and Method for Coloring Articles", filed on Mar. 8, 2013, now U.S. Pat. No. 9,668,538, which application is hereby incorporated by reference in its entirety.

BACKGROUND

The present embodiments relate generally to articles of footwear, and in particular to articles of footwear with sole systems.

Articles of footwear generally include two primary elements: an upper and a sole system. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

Sole systems can include one or more components or components. These can include outsoles, midsoles, insoles, inserts, bladders and/or airbags as well as possibly other articles or components.

SUMMARY

In one aspect, a coloring system for making a colored article includes an assembly, where the assembly has a central support member and a container having an open end. The container is attached to the central support member. The assembly includes at least one fastening structure configured to fasten an article within the container in a fixed position. The coloring system also includes an actuator that connects to the central support member, where the actuator is configured to introduce the assembly into a liquid coloring agent. The open end of the container allows the liquid coloring agent to contact a first portion of the article while suspending a second portion of the article above the liquid coloring agent. The actuator can rotate the assembly such that the article may rotate about a central axis of the assembly, where the central axis extends through a center of the central support member.

In some embodiments, the actuator can rotate the assembly in a clockwise direction. Alternatively, in some embodiments, the actuator can rotate the assembly in a counter-clockwise direction. In some embodiments, the actuator is capable of rotating the assembly in either or both directions.

In another aspect, the fastening structure comprises at least one bar and a spring clip member, and wherein the article is retained using the spring clip member to press the article against the at least one bar. In some embodiments, this fastening structure may be combined with the capability of the actuator to rotate the assembly in either or both the clockwise or counter-clockwise direction.

In some embodiments, the fastening structure may include multiple fastening bars disposed in various vertical locations. These fastening bars may be used to secure buoyant articles, which may tend to float in the liquid coloring agent unless properly retained by the fastening bars. In some embodiments, an upper fastening bar is used to retain an upper portion of the article and a lower fastening bar is used to retain a lower portion of the article. These two fastening bars, in conjunction with the spring clip, may help to hold the article in the desired position within the container. In some embodiments, this fastening arrangement is particularly useful in retaining buoyant articles in their proper position.

In another aspect, the coloring system includes two or more containers, where an assembly may include a first container and a second container. In some cases, the second container is substantially similar to the first container. Also, in some embodiments, the first container and the second container are both attached to the same central support member. It should be noted that this multiple container aspect may be combined with the fastening structure that comprises at least one bar and a spring clip member, and wherein the article is retained using the spring clip member to press the article against the at least one bar. In some embodiments, these aspects may both be combined with the capability of the actuator to rotate the assembly in either or both the clockwise or counter-clockwise direction.

In some embodiments, the actuator can further be used to raise and lower the assembly along a direction parallel with the central axis of the central support member. In some cases, this raise and lower feature may be combined with the multiple containers feature where the coloring system includes two or more containers, a first container and a second container. In some cases, the second container is substantially similar to the first container. Also, in some embodiments, the first container and the second container are both attached to the same central support member. It should be noted that these aspects may be combined with the fastening structure that comprises at least one bar and a spring clip member, and wherein the article is retained using the spring clip member to press the article against the at least one bar. In some embodiments, these aspects may all be combined with the capability of the actuator to rotate the assembly in either or both the clockwise or counter-clockwise direction.

In another aspect, a coloring system for making a colored article includes an assembly with a central support member having least one opening. The container has an open end, and the container is attached to the central support member. An opening of the central support member is in fluid communication with an interior region of the container. The assembly also includes a fastening structure configured to fasten an article within the container in a fixed position. The coloring system includes an actuator that connects to the central support member, where the actuator is configured to introduce the assembly into a liquid coloring agent. The open end of the container allows the liquid coloring agent to enter the container and form an initial air pocket within the container. The liquid coloring agent within the container then contacts a first portion of the article, while a second portion of the article is suspended above the liquid coloring agent. The second portion of the article that is suspended above the liquid coloring agent being disposed in the initial air pocket. The opening of the central support member allows gas to flow out of the container in order to increase the volume of the liquid coloring agent within the interior of the container, and also decrease the volume of the initial air pocket, when the container is at least partially filled with the liquid coloring agent.

In some embodiments, the opening of the container is in fluid communication with a fluid pump and the fluid pump is configured to remove the gas from the container when the fluid pump is activated. This can be used to control the size and volume of the air pocket.

In some embodiments, the assembly of the coloring system includes a sensor associated with the interior region of the container, and the fluid pump pulls air from the container in response to information from the sensor. In some cases, the sensor may include a pressure sensor. Alternatively, a fluid level sensor may be used. In some embodiments, both a pressure sensor and a fluid level sensor may be used.

In some embodiments, the coloring system may include an opening that is associated with a vent, where the vent can be actuated between an open position and a closed position, and where placing the vent in the closed position seals the interior region so that gas cannot escape from the interior region and wherein placing the vent in the open position allows gas to escape from the interior region. In some embodiments, the opening may also be placed in fluid communication with a fluid pump and the fluid pump is configured to remove the gas from the container when the fluid pump is activated. This can be used to control the size and volume of the air pocket. The vent feature may also be combined, in some embodiments, with a sensor associated with the interior region of the container, where the fluid pump pulls air from the container in response to information from the sensor. In some cases, the sensor may include a pressure sensor. Alternatively, a fluid level sensor may be used. In some embodiments, both a pressure sensor and a fluid level sensor may be used. The sensor associated with the interior region of the container may be used to influence the position of the vent, where the vent can be moved between the open position and the closed position in response to information from the sensor.

In another aspect, a method of coloring an article includes fastening an article to a container, where the container has an opening. The method also includes inserting at least a portion of the container into a liquid coloring agent associated with a color. The method also includes creating an air pocket within the container, where a first portion of the article is disposed within the air pocket of the container. The method also includes introducing a second portion of the article into the liquid coloring agent and removing air from the air pocket through the opening of the container to reduce the volume of the air pocket in order to color the second portion of the article with the color.

In another aspect, the method step of fastening the article to the container includes the step of fastening the article using a spring clip member.

In another aspect, the step of removing air from the air pocket includes pulling air from the container using a fluid pump.

In another aspect, the step of removing air form the air pocket includes opening a vent associated with the opening of the container to allow air to flow through the opening as liquid is introduced into an interior region of the container. In some cases, this vent aspect may be combined with a fluid pump, where the fluid pump may also be used to remove air from the air pocket of the container. In some cases, reducing the volume of the air pocket increases a fluid level of the liquid coloring agent within the container. Also, increasing the fluid level of the liquid coloring agent increases the size of the second portion of the article being colored by the liquid coloring agent. In some cases, the first portion of the article, which is disposed above the liquid coloring agent and within the air pocket, and the second portion of the article, which is submerged in the liquid coloring agent, are dissimilar in size.

In another aspect, the article may extend outside the container upon initially fastening the article and where the method includes moving the article to be positioned completely within an interior region of the container before introducing the container into the liquid.

In some cases, one or more of the following features may be used in combination with one another. For example, the method step of fastening the article to the container includes the step of fastening the article using a spring clip member may be combined with the step of removing air from the air pocket includes pulling air from the container using a fluid pump. These aspects may also be combined with the step of removing air from the air pocket using an opening and a vent associated with the opening of the container to allow air to flow through the opening as liquid is introduced into an interior region of the container. In some cases, this vent aspect may be combined with a fluid pump, where the fluid pump may also be used to remove air from the air pocket of the container. In some cases, reducing the volume of the air pocket increases a fluid level of the liquid coloring agent within the container. Also, increasing the fluid level of the liquid coloring agent increases the size of the second portion of the article being colored by the liquid coloring agent. In some cases, the first portion of the article, which is disposed above the liquid coloring agent and within the air pocket, and the second portion of the article, which is submerged in the liquid coloring agent, are dissimilar in size. These aspects may be combined with an initial condition where the article may extend outside the container upon initially fastening the article and where the method includes moving the article to be positioned completely within an interior region of the container before introducing the container into the liquid. In some cases, one or more of these aspects or features may be omitted.

The disclosure can include any combination of the various features set forth in this application. Any combination of disclosed features herein is considered part of the disclosure, and no limitation is intended with respect to combinable features.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
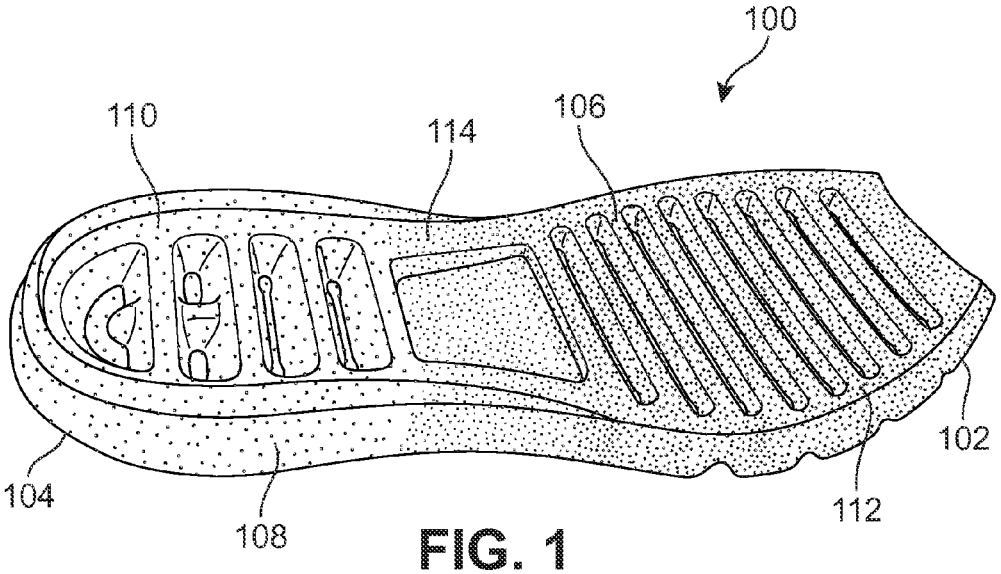
FIG. 1 is a schematic isometric view of an embodiment of a multi-colored article.
Figure 2:
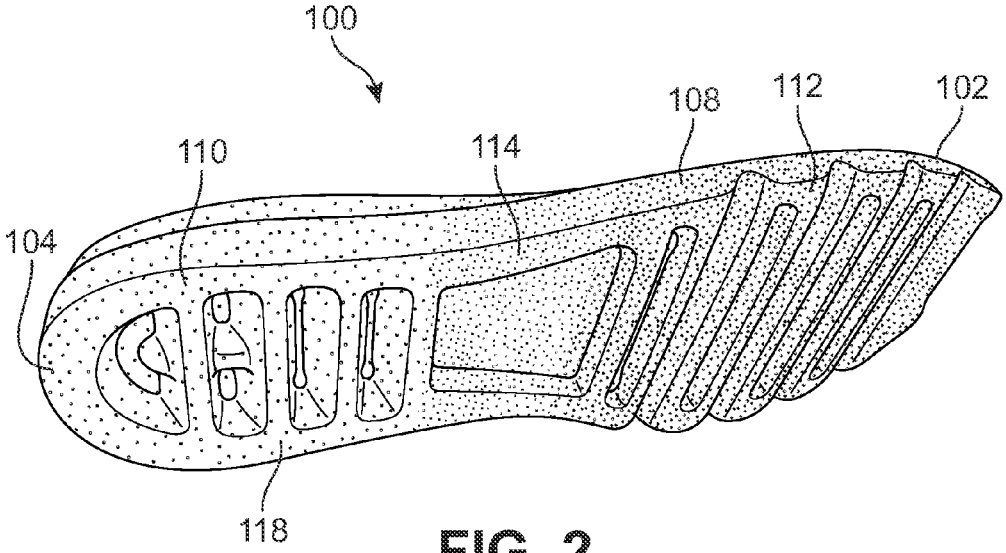
FIG. 2 is a different schematic isometric view of an embodiment of a multi-colored article.

FIGS. 1 and 2 are perspective views of an embodiment of a multicolored article 100. Article 100 may generally be associated with a sole system or sole structure for an article of footwear. In some embodiments, for example, article 100 could comprise a bladder member or airbag that is incorporated into a sole system. In some embodiments, article 100 could be further attached to additional components of a sole system including an outsole, midsole and/or insole. Moreover, it will be understood that article 100 could be used with any kind of sole system and type of footwear (e.g., running shoes, basketball shoes, football shoes, soccer shoes, boots, loafers, sandals, etc.).

Referring to FIGS. 1 and 2, article 100 may include front foot portion 102 and heel portion 104. In addition, article 100 includes a top side 106 (shown in FIG. 1) and a bottom side 118 (shown in FIG. 2). Top side 106 of article 100 would for instance be oriented toward a wearer's foot in an assembled shoe. Bottom side 108 may oriented towards a lower or ground contacting portion of a shoe (such as an outsole). Article 100 may further include peripheral edge 108 of article 100 is also partially shown. In some embodiments, peripheral edge 108 may be visible in an assembled sole of an athletic shoe.

In different embodiments, article 100 could have one or more colors. In the present embodiment, article 100 may be provided with at least two distinct colors, first color 110 on heel portion 104 and second color 112 on front foot portion 102. As an example, first color 110 could be yellow, while second color 112 could be blue. However, this example is only one of many possible color combinations and it will be understood that first color 110 and second color 112 could be any colors.

Some embodiments can incorporate transition areas between portions of different colors. In one embodiment, a transition area 114 can be disposed between heel portion 104 and front foot portion 102. In some embodiments, transition area 114 can be a blend of color 110 and color 112.

As seen in FIGS. 1 and 2, first color 110 and second color 112 permeate through article 100 so as to be visible from top side 106 or bottom side 118. Likewise first color 110 and second color 112 may be visible from peripheral edge 108. Although only one side of peripheral edge 108 is shown in FIGS. 1 and 2, it will be understood that the opposing side of peripheral edge 108 may have a substantially similar color pattern.

In some embodiments transition area 114 can be omitted. Instead a line of demarcation between two colors could be visible. In other embodiments only one color may be used to color article 100. In still other embodiments, three or more distinct colors could be used, with or without transition areas between adjacent distinct colors.

Embodiments can include provisions to facilitate coloring an article to achieve the multicolor effect shown in FIGS. 1 and 2 (as well as other possible color schemes). In embodiments where an article is colored using a dye, for example, a system and associated method can include provisions to dye portions of the article, rather than the entire article.

Figure 3:
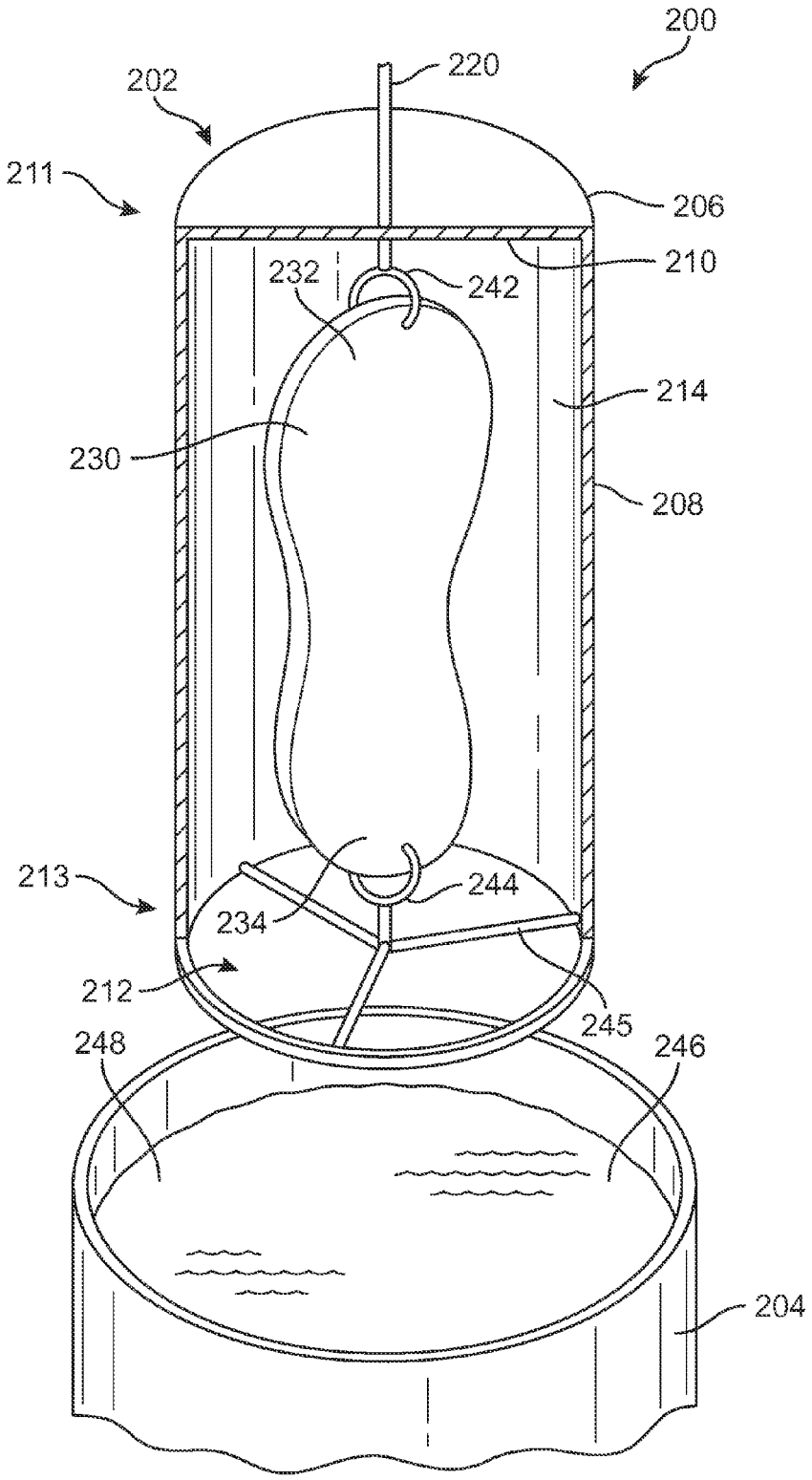
FIG. 3 is a schematic isometric cutaway view of an embodiment of an apparatus used to produce a multicolored article.

FIG. 3 is a cutaway isometric view of an embodiment of an apparatus 200 used to produce multicolored article 100 such as shown in FIGS. 1 and 2. Apparatus 200 may include assembly 202, tank 204 and provisions for maneuvering assembly 202 with respect to tank 204. As discussed in further detail below, assembly 202 is configured to retain an article, while tank 204 may be filled with a liquid coloring agent to be applied to the article.

In some embodiments, assembly 202 may further include a container 206. Container 206 may include a side wall 208. In some embodiments, container may be closed at a first end portion 211 and open at a second end portion 213. In one embodiment, container 206 can include a top wall 210 at first end portion 211 and a bottom opening 212 at second end portion 213. Bottom opening 212 may provide access to an interior 214, which is bounded by side wall 208 and top wall 210.

In different embodiments, the geometry of container 206 could vary. In the exemplary embodiment shown in the figures, container 206 has an approximately cylindrical shape. More specifically, side wall 208 may be a cylindrical wall, while top wall 210 may be circular. However, in other embodiments, container 206 could have any other geometry including, but not limited to: a spherical geometry, a pyramidal geometry, a rectangular prism geometry or any other three-dimensional geometry (including both regular and irregular geometries).

Tank 204 may be configured to retain a liquid coloring agent 246. Here, liquid coloring agent 246 may be associated with a color 248. The term "liquid coloring agent" as used throughout this detailed description and in the claims refers to any liquid that includes or incorporates one or more coloring agents. Liquid coloring agents can include, but are not limited to: liquids with any kinds of coloring agents, including liquids with dyes, liquids with pigments or any other liquid based coloring agents that are known in the art.

The embodiments of the articles described herein may incorporate dyeing methods as well as particular dye compositions. Some embodiments may use one or more of the features, methods, systems and/or components disclosed in the following documents: Tutmark, United States Patent Application Publication 2014/0256468, now U.S. patent application Ser. No. 13/786,031, filed Mar. 5, 2013, titled "Method for Dyeing Golf Balls and Dyed Golf Balls"; Schoborg, United States Patent Application Publication 2014/0250611, now U.S. patent application Ser. No. 13/786,056, filed Mar. 5, 2013, titled "Acid Dyeing of Polyurethane Materials"; Tutmark, United States Patent Application Publication 2014/0250609, now U.S. patent application Ser. No. 13/786,043 filed Mar. 5, 2013, titled "Method for Dyeing Golf Balls and Dyed Golf Balls"; Bracken et al., U.S. Pat. No. 7,611,547, issued Nov. 3, 2009 and titled "Airbag Dyeing Compositions and Processes," where the entirety of each document is incorporated by reference.

For purposes of illustration, tank 204 is shown as having a cylindrical geometry. However, the geometry of tank 204 could vary in other embodiments. In some embodiments, the geometry of tank 204 could be substantially similar to the geometry of container 206. In other embodiments, however, the geometry of tank 204 could be substantially different from the geometry of container 206. Other exemplary geometries for tank 204 include, but are not limited to a spherical geometry, a pyramidal geometry, a rectangular prism geometry or any other three-dimensional geometry (including both regular and irregular geometries).

Embodiments can include provisions to position container 206. In some embodiments, apparatus 200 includes actuator 220 which may be used to adjust the position of container 206 relative to tank 204. In some embodiments, actuator 220 could be used to raise and lower container 206 with respect to tank 204. For purposes of illustration, only a portion of an actuator that is in contact with container 206 is shown in the figures. Any suitable type of mechanism can be used to raise and lower container 206. Some examples of possible of devices include linkages, pulley system, ropes, cables, which could be mechanized or manual, for example.

In order to fasten an article within container 206, assembly 202 can include one or more retaining members, which may also be referred to as fastening members. In the exemplary embodiment, upper retaining member 242 and lower retaining member 244 are provided inside the container 206. In particular, upper retaining member 242 may be secured to top wall 210 of container 206. In some embodiments, a retaining member bracket 245 secures lower retaining member 244 to a lower portion of side wall 208. In the example shown, an article 230 is positioned vertically within container 206. Specifically, front foot portion 232 of article 230 is secured in container 206 by upper retaining member 242. Also, heel portion 234 of article 230 is secured in container 206 by lower retaining member 244.

First retaining member 242 and second retaining member 244 can be any suitable means for retaining article 230 inside container 206 in a secure position. Some embodiments may employ clips, clamps, tension rods, hooks, or brackets as retaining members. Still other embodiments could use any other kinds of retaining members known in the art for temporarily fixing or holding an article in place.

As seen in FIG. 3, container 206 may be arranged in an inverted position with respect to tank 204. In particular, second end portion 213, which includes bottom opening 212, is disposed closer to tank 204 than first end portion 211. As described in further detail below, this arrangement allows liquid coloring agent 246 to partially fill interior 214 as container 206 is lowered into tank 204.

In FIG. 3, an embodiment of the assembly 202 is depicted before introducing container 206 into tank 204. Article 230, in an uncolored/un-dyed state is shown disposed inside inverted container 206. In this particular configuration, article 230 is retained at front foot portion 232 and at heel portion 234.

Figure 4:
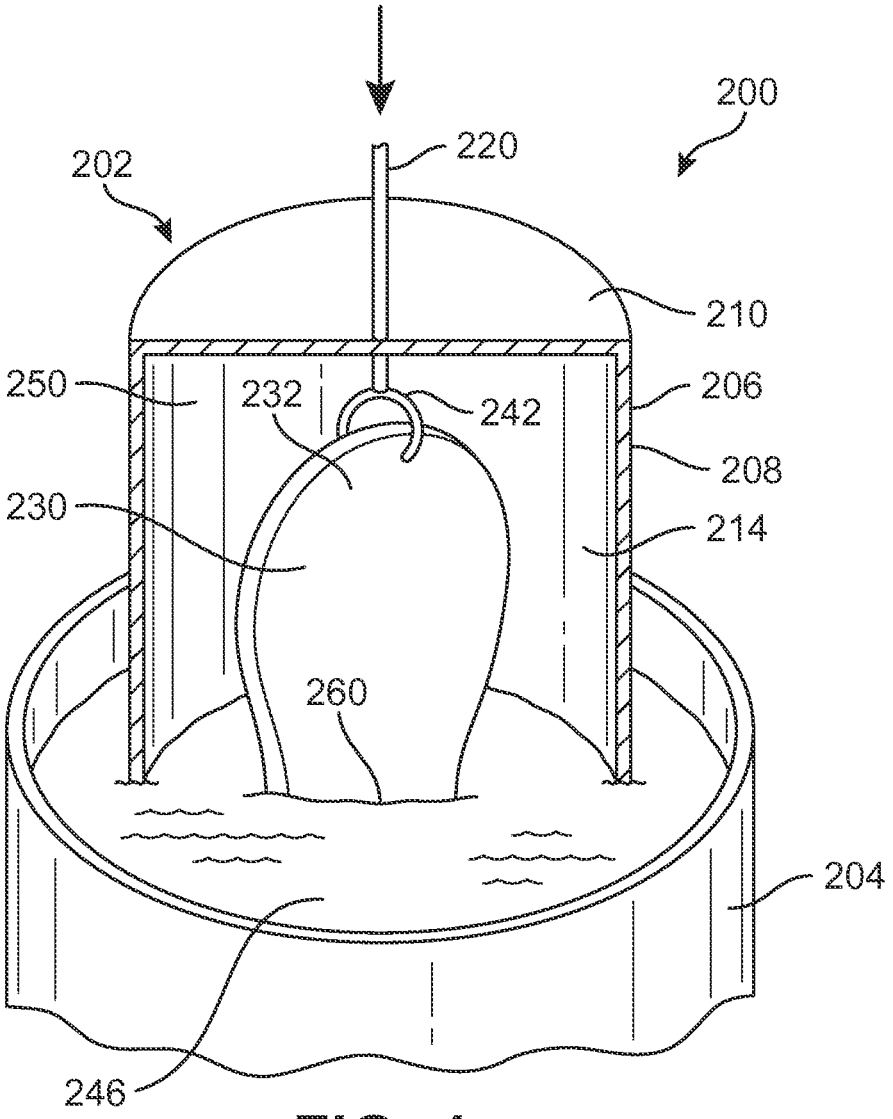
FIG. 4 is different schematic isometric cutaway view of an embodiment of an apparatus used to produce a multicolored article.
Figure 5:
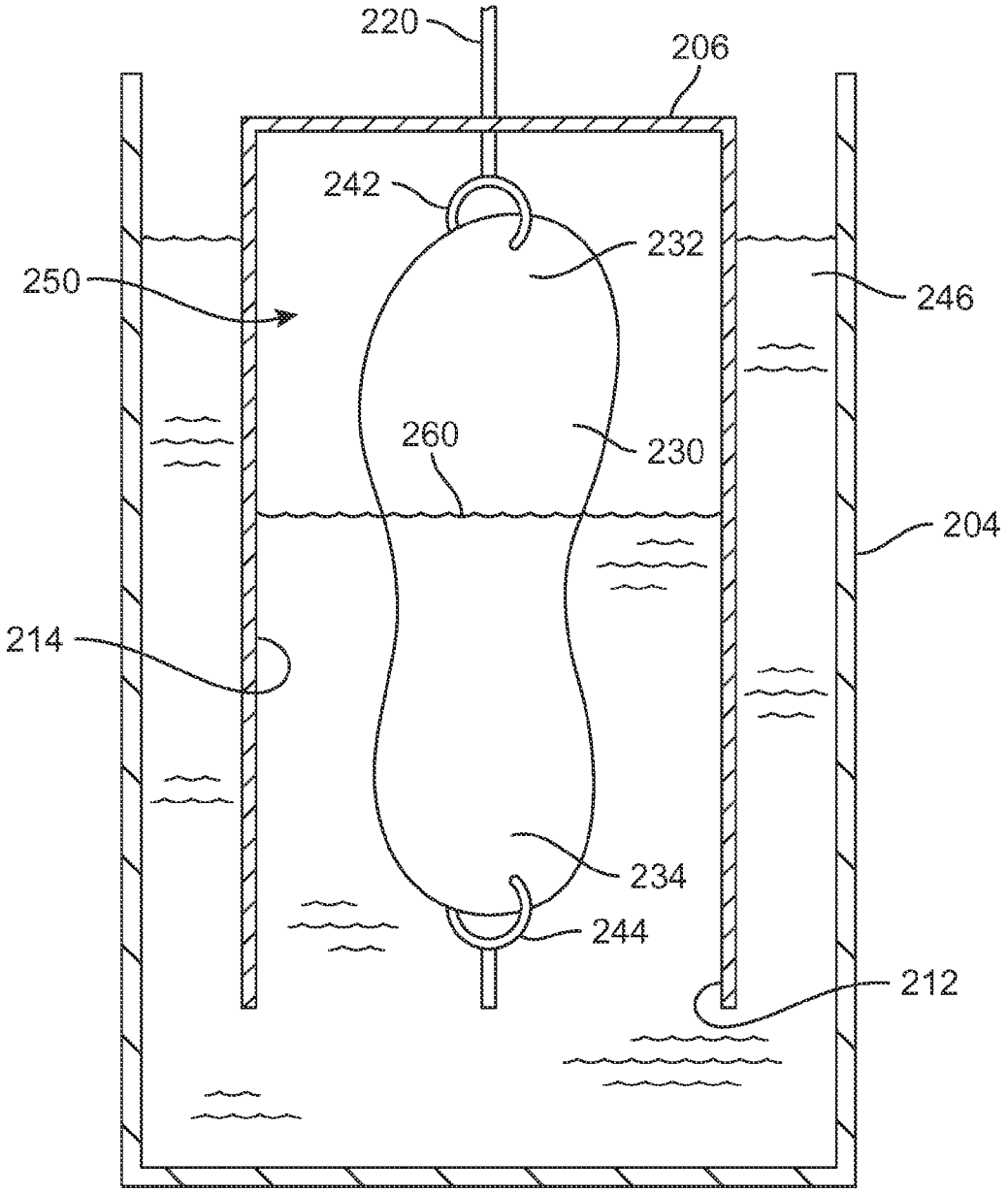
FIG. 5 is a schematic view of an embodiment of an apparatus shown in FIGS. 3 and 4, in a different position.

FIGS. 4 and 5 show an embodiment of assembly 202 in a process of lowering container 206 into tank 204. As discussed above, tank 204 may be filled with liquid coloring agent 246. In some embodiments, liquid coloring agent 246 may comprise a liquid dye. In some embodiments, liquid coloring agent 246 may be a liquid dye with a color 248.

Referring to FIG. 4, actuator 220 lowers container 206 into tank 204 as indicated by a downward pointing arrow. As container 206 is lowered, a portion of container 206 is introduced into tank 204. Bottom opening 212 of container 206 allows for liquid coloring agent 246 to enter interior 214 of container 206.

Air pocket 250 is created as container 206 is lowered into tank 204. In particular, as bottom opening 212 of container 206 comes into contact with liquid coloring agent 246, air within interior 214 of container 206 becomes trapped (or sealed) within container 206. Specifically, the air within interior 214 is captured within the volume bounded by top wall 210, side wall 208 and the surface of liquid coloring agent 246.

In the configuration of FIG. 4, article 230 is shown as partially dipped into liquid coloring agent 246. Heel portion 234 (not visible) is submersed in the liquid coloring agent 246. However, front foot portion 232 in disposed above the surface of liquid coloring agent 246 and within air pocket 250.

In some embodiments, article 100 may be buoyant. For example, in embodiments where article 230 is a bladder member or airbag, article 230 may be especially buoyant and resist being submerged in a liquid. Therefore, upper retaining member 242 and lower retaining member 244 may prevent article 230 from floating while being dipped into liquid coloring agent 246. This arrangement allows open bottom 212 of container 206 to be at least partially submersed below a liquid level in tank 204.

As seen in FIG. 5, the liquid level 260 (also shown in FIG. 4) of liquid coloring agent 246 within the container 206 may vary with the volume of air pocket 250. The volume of air pocket 250 may vary with the depth of submersion of container 206 within tank 204. In particular, as container 206 is further submerged, the volume of air pocket 250 may be further compressed. In some embodiments, the volume of air pocket 250 could be controlled independently from the submersion depth by using other provisions to increase the pressure within air pocket 250 and thereby maintain an approximately constant volume.

With container 206 submerged to a predetermined level within tank 204, liquid level 260 defines the transition between a first portion of article 230 that is outside of liquid coloring agent 246 and a second portion of article 230 submerged within liquid coloring agent 246. Here, the first portion is front foot portion 232 while the second portion is heel portion 234. In other embodiments, however, the first portion and the second portion could be any other portions. By holding container 206 at this depth for a predetermined period of time heel portion 234 of article 230 can be colored by liquid coloring agent 246. In this case, container 206 is shown as mostly, but not entirely submerged within liquid coloring agent 246. In other embodiments, container 206 could be completely submerged within liquid coloring agent 246.

Figure 6:
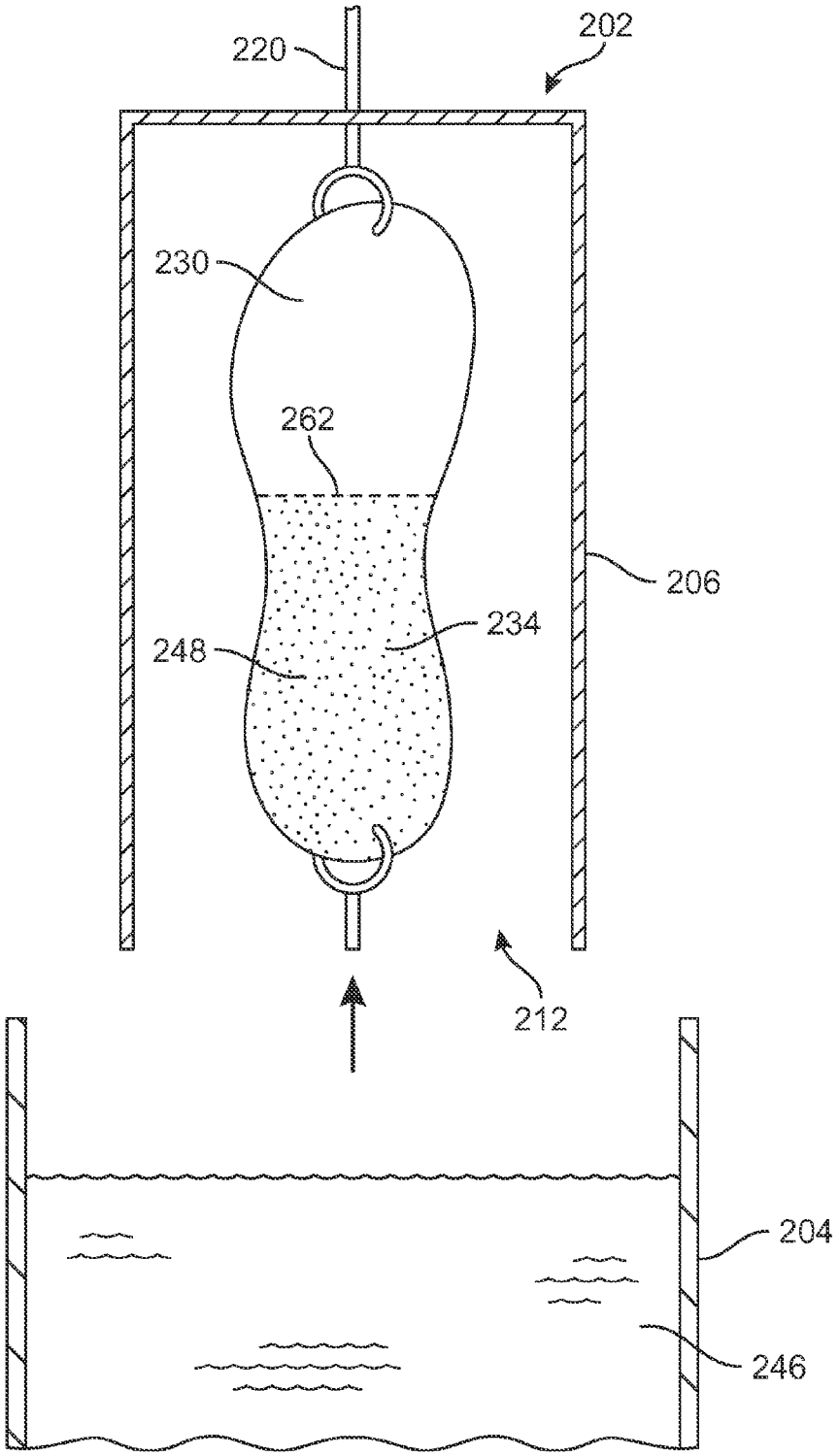
FIG. 6 is a schematic view of an embodiment of an apparatus shown in FIG. 5, in a different position.

FIG. 6 illustrates an embodiment of container 206 being raised from tank 204 through the use of actuator 220. As container 206 is raised, liquid coloring agent 246 can exit container 206 through bottom opening 212. Dipped article 230 is shown having color 248 on heel portion 234 below coloring line 262. According to an exemplary embodiment, article 230 is dipped once into tank 204 to color heel portion 234 of article 230.

In some embodiments article 230 can be dipped any number of times to achieve different coloring effects. Dipping an article multiple times can be used to achieve desired results in color saturation, to provide color transition areas, etc. In some embodiments, multiple successive quick dippings of article 230 achieves faster results than fewer long dips.

Figure 7:
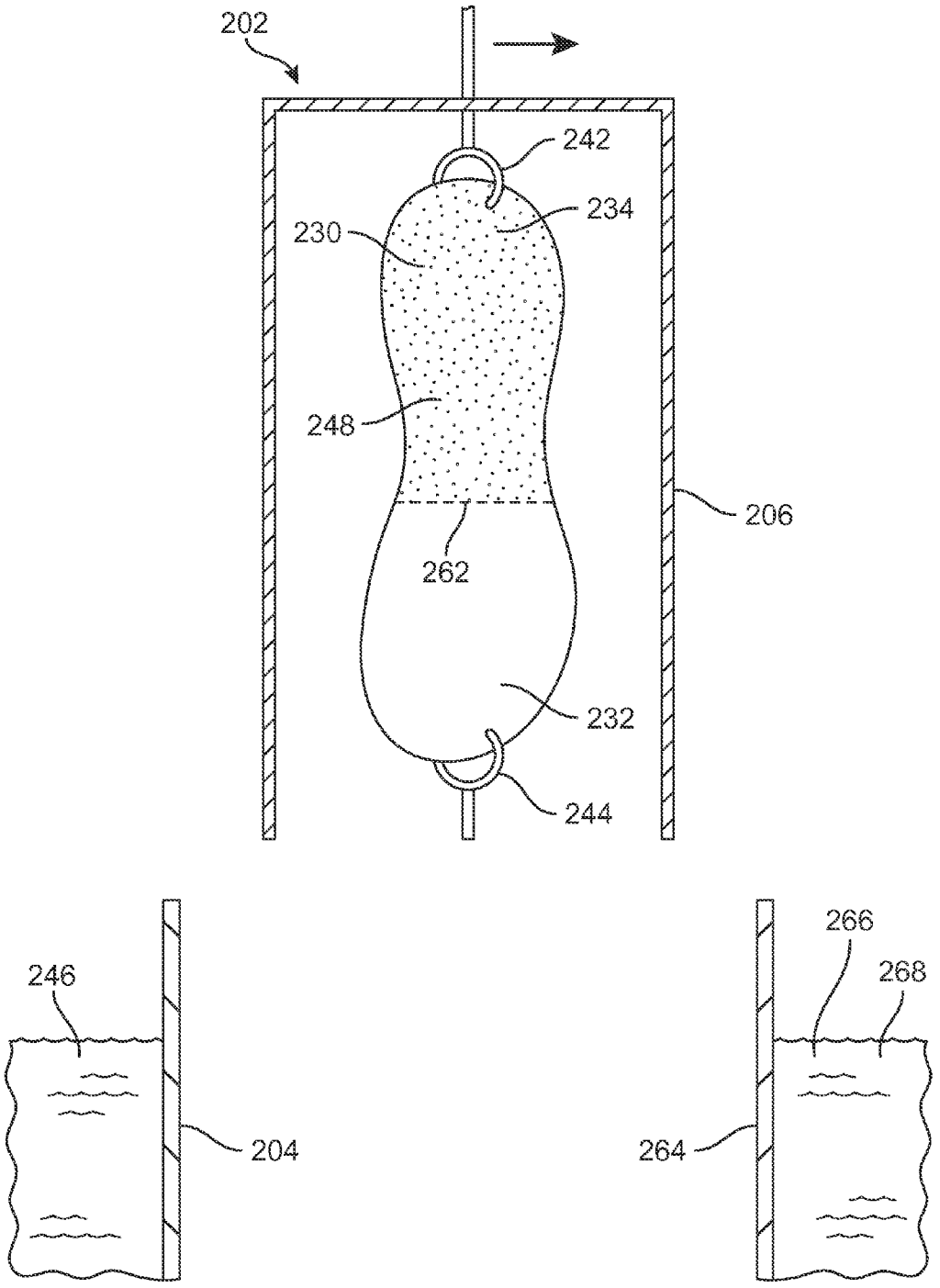
FIG. 7 is a schematic view of an embodiment of an apparatus shown in a different position, with an inverted article.
Figure 8:
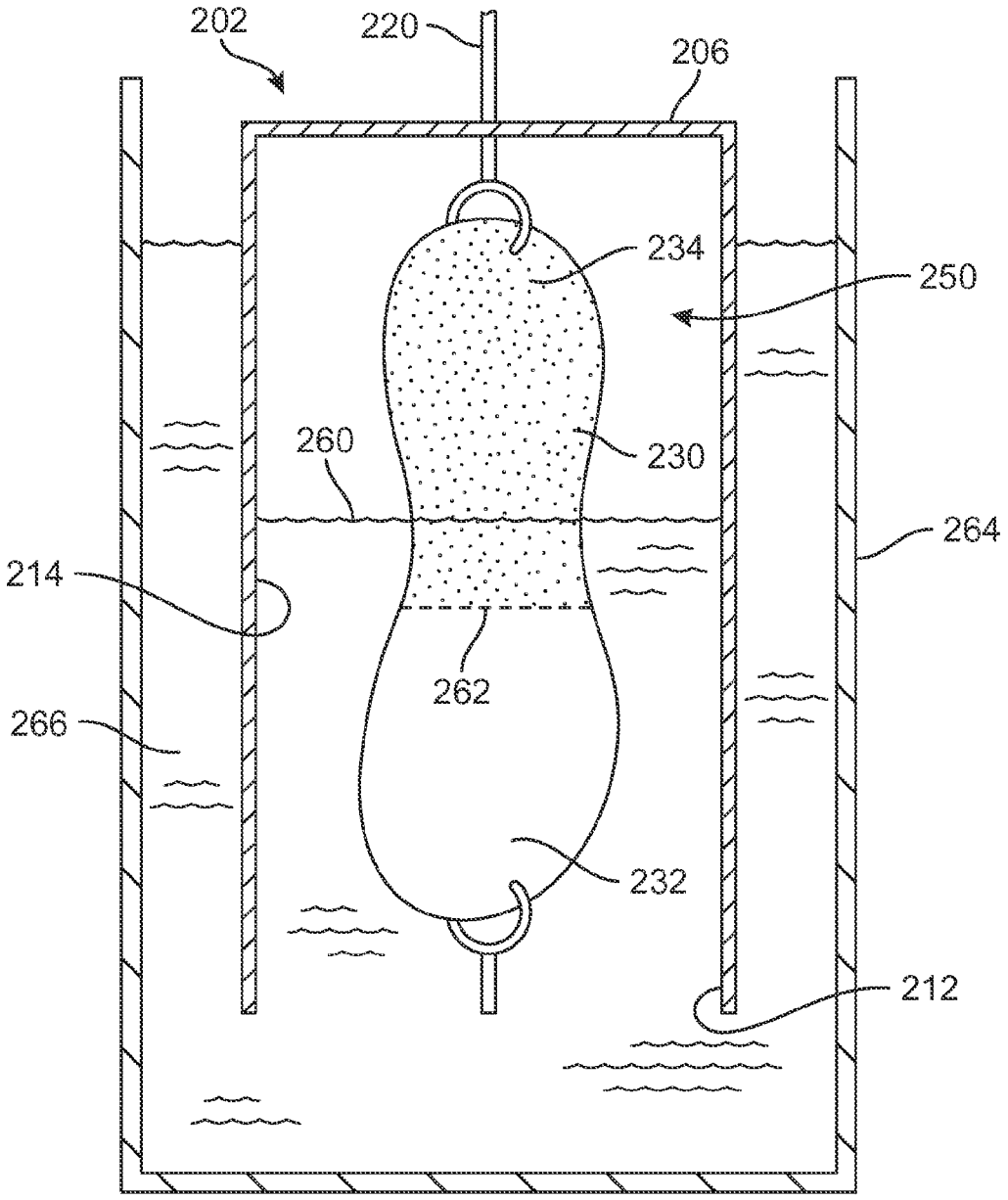
FIG. 8 is a schematic view of an embodiment of an apparatus shown in yet a different position, with an inverted article.
Figure 9:
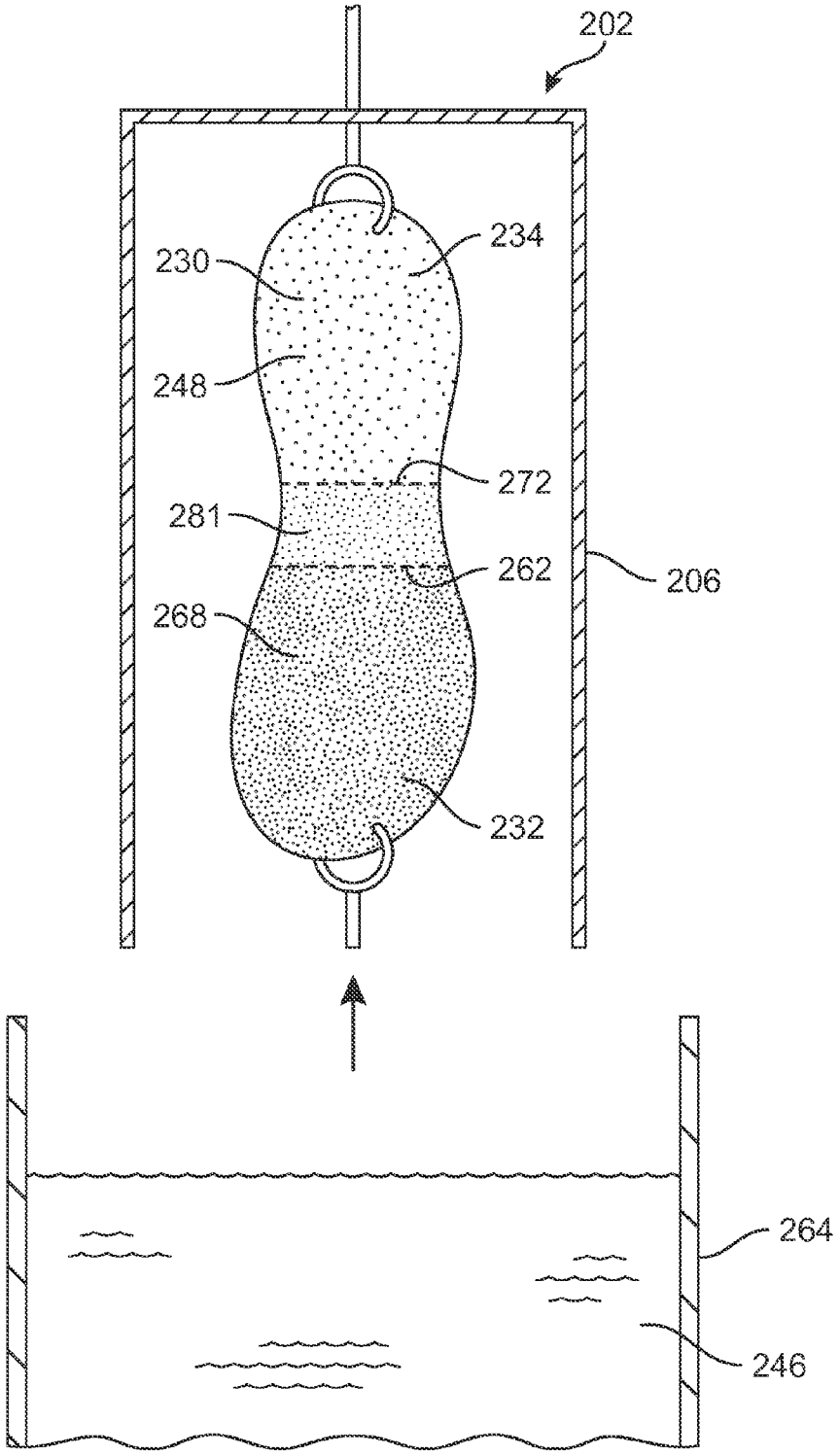
FIG. 9 is a schematic view of an embodiment of an apparatus shown in yet a different position, with an inverted article.

FIGS. 7 through 9 illustrate schematic views depicting several additional steps that may be used to produce a multicolored article, according to an embodiment. It will be understood that these steps are optional and some embodiments may not include them, especially in embodiments where only a single color is desired.

Referring first to FIG. 7, article 230 may be inverted within container 206, with respect to the position of article 230 shown in the previous figures (e.g., FIG. 6). Thus, heel portion 234 is now secured in container 206 by upper retaining member 242. Also front foot portion 232 of article 230 is secured in container 206 by lower retaining member 244. Inverting the article 230 prepares the un-colored front foot portion 232 for dipping into next tank 264.

As also shown in FIG. 7, assembly 202 may be moved/transferred from tank 204 toward next tank 264. This is indicated by the horizontal arrow that is representative of any means for moving assembly 202, such as a conveyer device. This can occur before, after, or during the inversion of article 230 within container 206. Tank 264 may be filled with a liquid coloring agent 266 of color 268. In some embodiments, liquid coloring agent 266 may be a liquid dye. In an exemplary embodiment, color 268 is different from color 248.

In some embodiments any type of mechanism capable of transferring assembly 202 from tank 204 to next tank 264 can be employed. Some examples of possible of devices include, but are not limited to: linkages, pulley systems, ropes, cables, as well as possibly other devices, which could be mechanized or manual.

In some embodiments additional dips of the article may be performed in additional tanks. Additional dips can be for rinsing, coating, or sealing the article, for example. Furthermore some embodiments can include drying operations in between dips of the article. These additional dips or operations can occur before, between, or after the dips of the articles as set forth above.

FIG. 8 shows an embodiment of assembly 202 in step of lowering container 206 into next tank 264. This illustrates a second lowering or dipping of container 206 to dip the un-colored front foot portion 232 of article 230 into next tank 264. In this step, actuator 220 lowers container 206 into tank 264 that is filled with liquid coloring agent 266. Open bottom 212 of container 206 allows for liquid coloring agent 266 to enter interior 214 of container 206. As described previously, air pocket 250 is created as container 206 is lowered into tank 264. In this arrangement, heel portion 234 is shown as being disposed in air pocket 250. In other words, heel portion 234 is not in contact with liquid coloring agent 266.

In the embodiment shown, front foot portion 232 of article 230 is shown as partially dipped into liquid coloring agent 266. In some embodiments, article 230 could be submerged to a point where coloring line 262 is submerged below liquid level 260. This allows some portions of article 230 that have already been colored with color 248 to be additionally colored with liquid coloring agent 266. As discussed below, this creates a color transition region that is a blend of color 248 and color 268. However, in other embodiments, coloring line 262 could be disposed above liquid level 260, such that no portion of article 230 is colored more than once.

FIG. 9 illustrates an embodiment of assembly 202 after the step of dipping container 206 into tank 264. Referring to FIG. 9, dipped article 230 is shown having color 268 on front foot portion 232 below coloring line 262, and color 248 on heel portion 234 above coloring line 272. Coloring line 262 is made while dipping article 230 in tank 204. Coloring line 272 was made when dipping article 230 in tank 264. According to an exemplary embodiment, article 230 is dipped once into tank 264 to dye front foot portion 232 of article 230.

Additionally, in this embodiment, dipped article 230 has a color transition portion 281, which is disposed between coloring line 262 and coloring line 272. Transition portion 281 comprises a blend of color 248 and color 268.

As previously described, in some embodiments article 230 can be dipped any number of times to achieve different coloring effects. Dipping an article multiple times can be used to achieve desired results in color saturation, to provide color transition areas, etc. In some cases, the volume of air pocket 250 within container 206 can be varied in successive multiple dips to achieve varying results.

Figure 10:
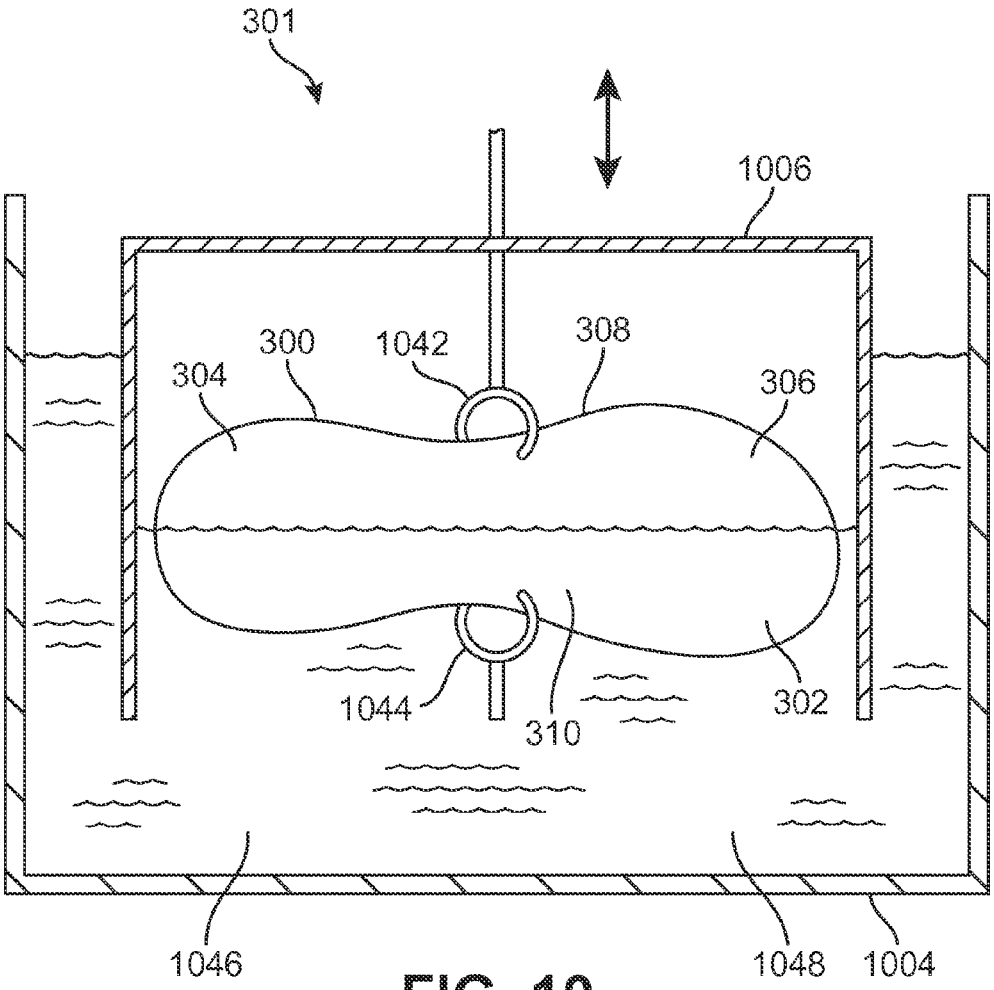
FIG. 10 is a schematic view of an embodiment of an apparatus holding an article in a different position.

FIG. 10 depicts an embodiment having an alternative retaining position of article 300. In the example shown, article 300, which includes a front foot portion 302 and a heel portion 304, is positioned horizontally, rather than vertically as in the previous embodiment. Top side 306 of article 300 is viewed in the plane of the drawing. In this configuration, a lateral peripheral edge portion 308 of article 300 is secured in container 1006 by upper retaining member 1042. Medial peripheral edge portion 310 of article 300 is secured in container 1006 by lower retaining member 244.

Assembly 301 is shown being lowered into tank 1004 filled with liquid coloring agent 1046 of color 1048 for example. The process for coloring article 300 is repeated according to the previous exemplary embodiment discussed above and shown in FIGS. 3 through 8. However, it will be understood that article 300 in the present embodiment is inverted in the container 1006 in a manner (not shown) such that when inverted medial peripheral edge portion 310 is secured in container by upper retaining member 1042. Further, lateral side peripheral edge portion 308 of article 300 is secured in container by lower retaining member 1044 in the inverted position. Container 1006 is then transferred and submerged into another tank for applying another color.

These embodiments show some possible orientations for an article with respect to the surface of a liquid coloring agent. In particular, the embodiments depict configurations where the article may be vertical to the surface (e.g., FIG. 5) or horizontal (e.g., FIG. 10). In other embodiments, the position of the article can be angled relative to the liquid coloring agent surface, rather than being vertically or horizontally oriented.

Figure 11:
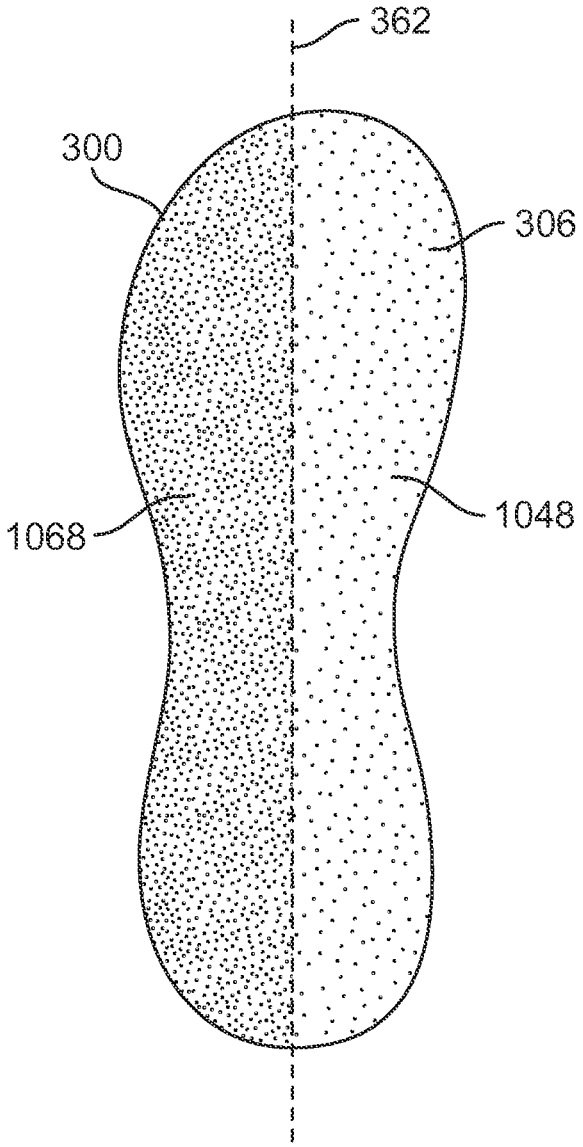
FIG. 11 is a schematic view of an embodiment of a multi-colored article resulting from an apparatus embodied in FIG. 10.

FIG. 11 shows an embodiment of resulting article 300 according to the above described production steps. Multi-colored article 300 is shown with top side 306 viewed in the plane of the drawing. On a medial side of coloring line 362, article 300 is dyed with color 1048. On a lateral side of coloring line 362, article 300 is dyed with another color 1068. Although no transition area is shown, it will be understood that a transition area blending color 1048 and color 1068 could be provided to the medial and lateral sides of coloring line 362. Furthermore, since the colors permeate the article, the colors are visible from the top side 306, bottom side (not shown), and peripheral edges (not shown).

Figure 12:
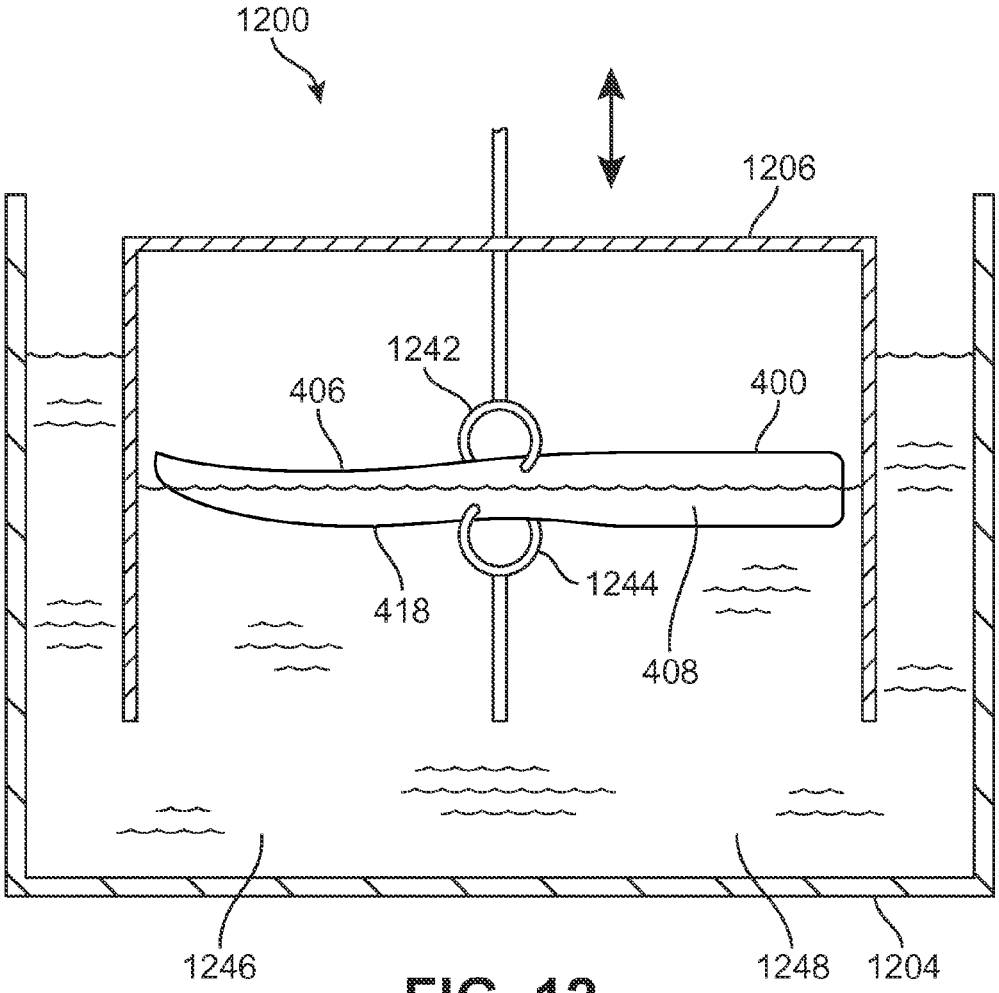
FIG. 12 is a schematic view of an embodiment of an apparatus holding an article in yet a different position.

FIG. 12 illustrates a variation for an embodiment having another alternative retaining position of article 400. In the example shown, the article 400 is again positioned horizontally. However, a side view of article is shown. Peripheral edge 408 is in the plane of the drawing. Top side 406 of article 400 is secured in container 1206 by upper retaining member 1242. Bottom side 418 of article 400 is secured in container 1206 by lower retaining member 1244.

Assembly 1200 is shown lowered into tank 1204 filled with liquid coloring agent 1246 of color 1248 for example. The process for dying article 400 is repeated according to the first exemplary embodiment discussed above and shown in FIGS. 3 through 8. However, it will be understood that article 400 in the present embodiment is inverted in container 1206 in a manner (not shown) such that bottom side 418 is secured in container 1206 by upper retaining member 1242. Further, top side 406 of article is secured in container 1206 by lower retaining member 1244. Container 1206 can then transferred and submerged into another tank.

Figure 13:
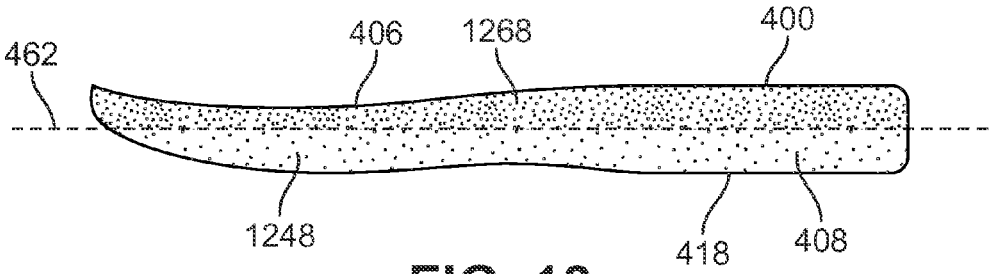
FIG. 13 is a schematic view of an embodiment of a multi-colored article resulting from an apparatus embodied in FIG. 12.

FIG. 13 shows an embodiment of resulting article 400 according to the above described steps. Multi-colored article 400 is shown with peripheral edge 408 visible. Bottom side 418 of article 400 is dyed with color 1248 below coloring line 462. Top side 406 of article 400 is dyed with color 1268 above dye line 462. Although no transition area is shown, it will be understood that a transition area blending color 1248 and color 1268 could be provided above and below coloring line 462. Furthermore, since the dye colors permeate the article, the colors are visible from the top side 406, bottom side 418, and peripheral edge 408.

Embodiments can include provisions for coloring multiple articles simultaneously within a single tank of liquid coloring agent. For example, some embodiments could include provisions for retaining multiple articles at the same height within a container, thereby allowing the multiple articles to be colored simultaneously. As another example, some embodiments could incorporate assemblies with stacked containers, where one or more articles can be colored within each container and where the entire assembly could be submerged into a tank of liquid coloring agent.

Figure 14:
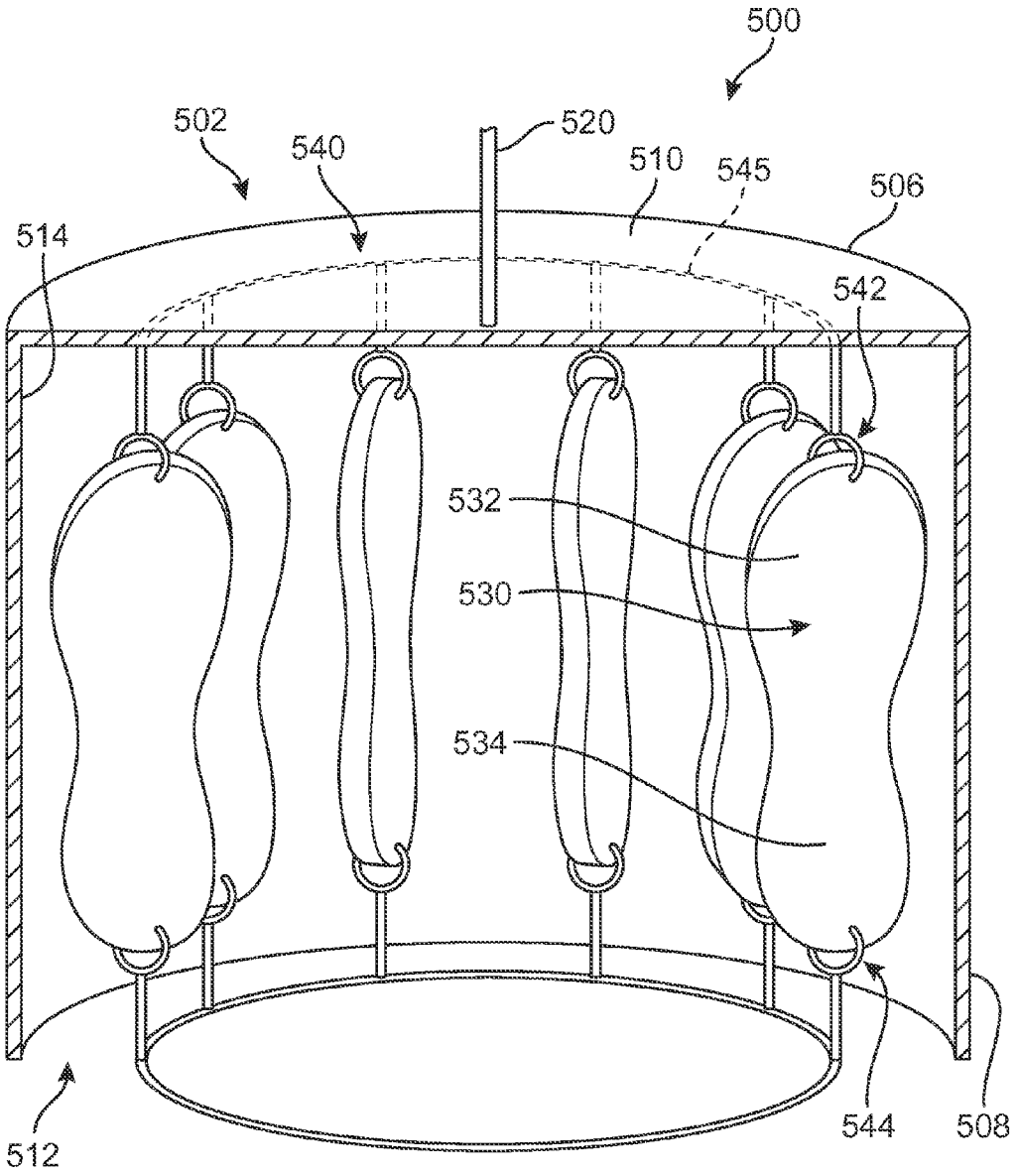
FIG. 14 is a schematic isometric cutaway view of an embodiment of an apparatus used to produce multiple multicolored articles.

FIG. 14 is a cutaway isometric view of an embodiment of apparatus 500 for dipping multiple articles 530 simultaneously. Apparatus 500 includes assembly 502. Assembly 502 has an inverted container 506, which may include a side wall 508 and a top wall 510. Container 506 may have a bottom opening 512 at a lower end. In operation, container 506 can be raised and lowered by actuator 520 into a tank (not shown for simplicity). Any suitable type of mechanism can be used as an actuator 520 to raise and lower container 506.

A carousel 540 for mounting multiple articles 530 is disposed inside the container. Carousel 540 includes a cylindrical bracket 545 mounted to the interior 514 of container 506. Cylindrical bracket 545 is provided with upper retaining members 542 and lower retaining members 544 which are axially spaced from each other. Upper retaining members 542 and lower retaining members 544 are secured at their upper and lower ends by the cylindrical bracket 545. In the present example, multiple articles 530 are shown being secured within cylindrical bracket 545 in a vertical position.

Uncolored/un-dyed articles 530 are positioned in carousel 540. Articles 530 are retained at their respective front foot portions 532 and at heel portions 544. Upper retaining members 542 and lower retaining members 544 can be any suitable means for retaining articles into cylindrical bracket, as described previously with respect to other embodiments. Front foot portions 532 of articles 530 are secured in cylindrical bracket 545 by upper retaining members 542. Heel portions 534 of articles 530 are secured in cylindrical bracket 545 by lower retaining members 544.

Figure 15:
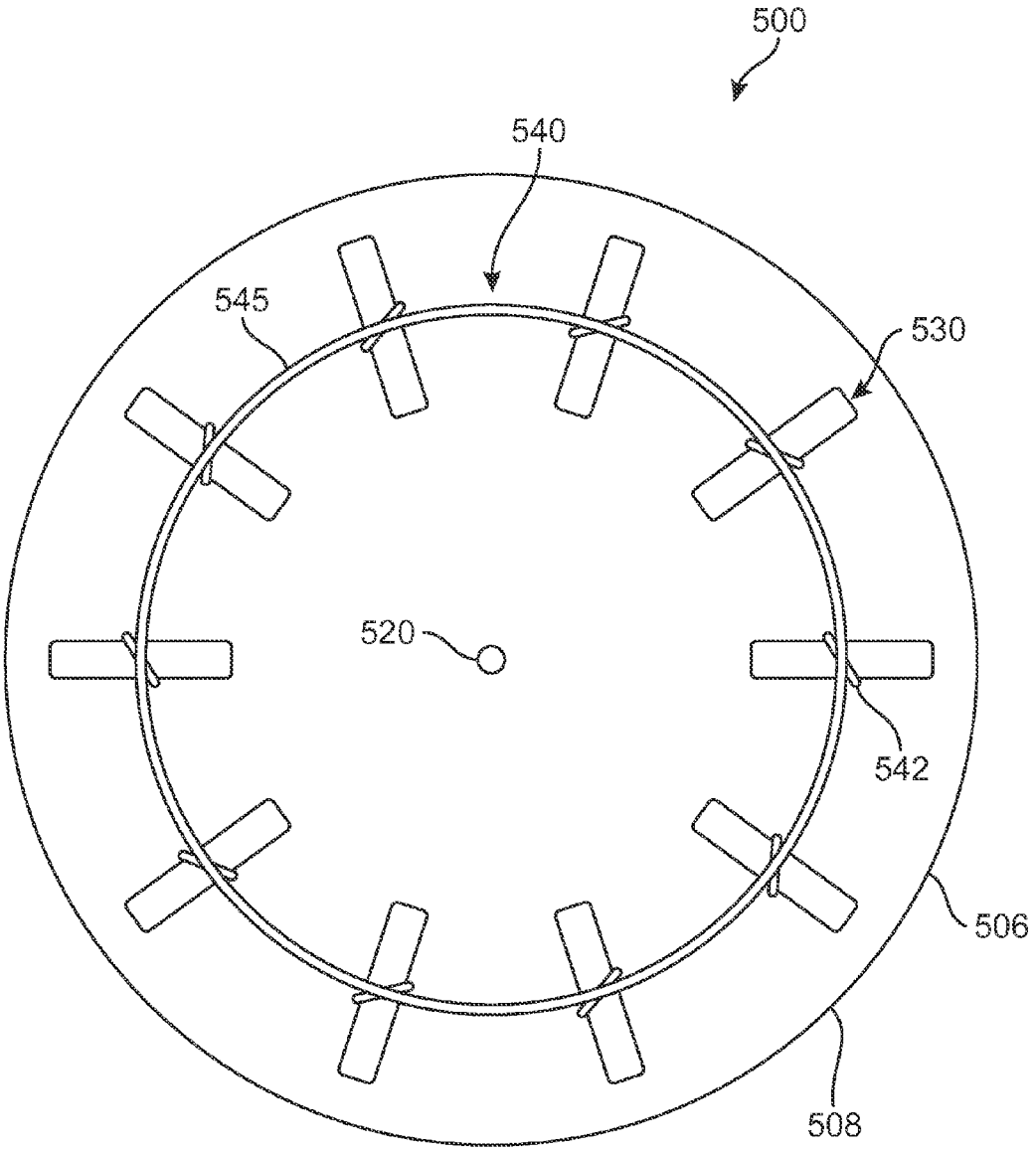
FIG. 15 is a schematic plan view of an apparatus embodied in FIG. 14.

FIG. 15 is a top view of an embodiment of apparatus 500. Carousel 540 is shown holding multiple articles 530 in axially spaced positions. Cylindrical bracket 545 supports ten articles 530 in the present example. In other embodiments carousel 540 and bracket 545 can be any shape, such as square, rectangular, oval, spherical, or pyramidal, for example. Furthermore, in some embodiments bracket can be provided with any number of upper retaining members 542 and lower retaining members 544 (not shown) to hold multiple articles.

Figure 16:
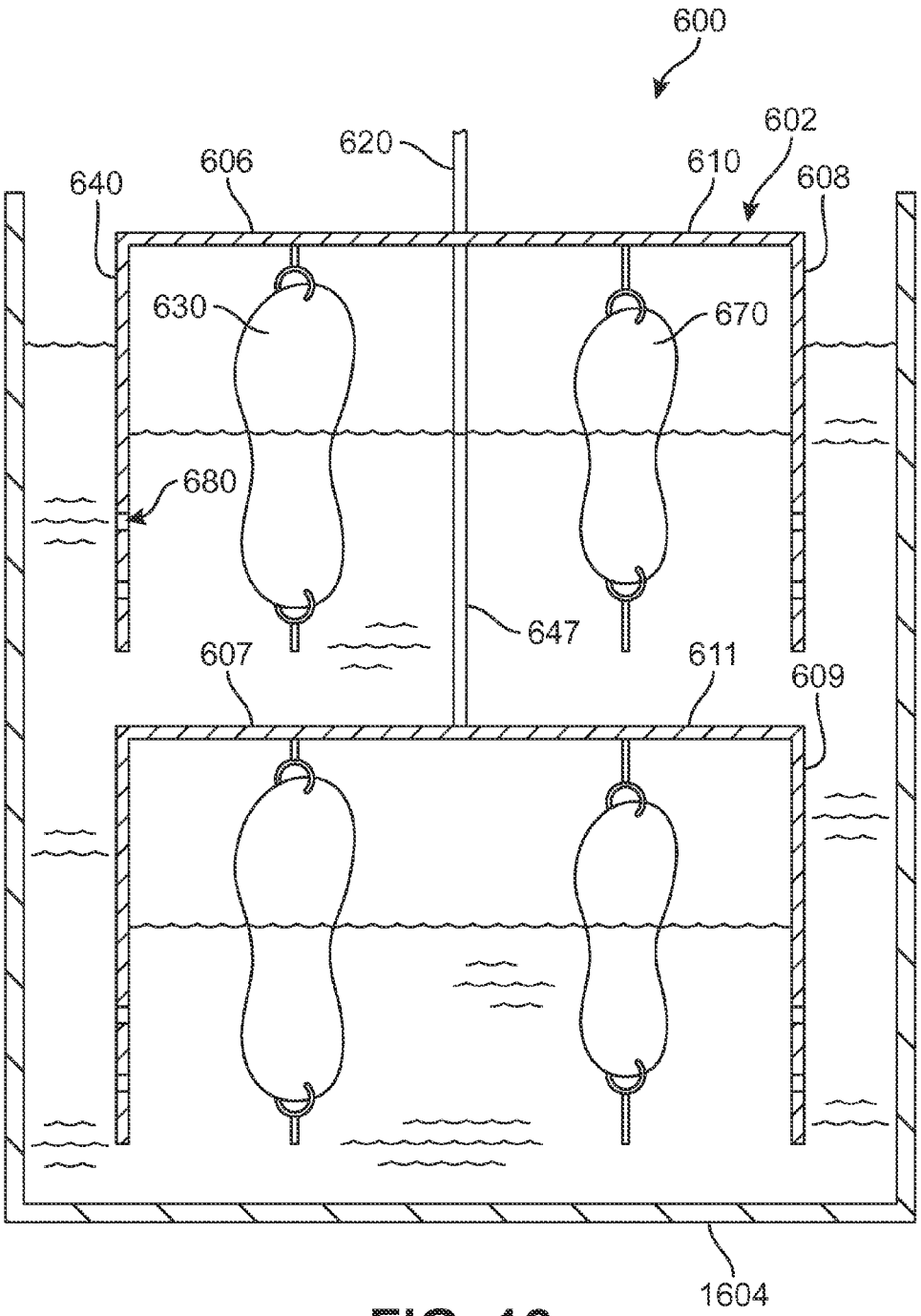
FIG. 16 is a schematic view of another embodiment of an apparatus used to produce multiple multicolored articles.

FIG. 16 shows an embodiment of assembly 600. Apparatus 600 includes assembly 602. Assembly 602 has two inverted containers including first container 606 and second container 607. First container 606 and second container 607 may be vertically stacked and connected by a connector 647 (for example, a rod). First container 606 and second container 607 include first top wall 610 and second top wall 611, respectively. Additionally, first container 606 and second container 607 include first side wall 608 and second side wall 609, respectively. Furthermore, each of first container 606 and second container 607 may be open at their lower ends.

For purposes of clarity, first container 606 and second container 607 are shown in cross-section. However, it will be understood that the geometry of each container could vary in different embodiments. Furthermore, in this embodiment, each container is shown without any bracket details for simplicity. Also, each container is shown holding only two articles for simplicity. The articles 630 are positioned for example in the same manner as in the previous embodiment.

In some embodiments with multiple containers, the containers can be positioned side by side, rather than stacked vertically.

Apparatus 600 includes actuator 620 which is used to raise and lower containers 606. Containers 606 can be raised and lowered by actuator 620. Any suitable type of mechanism can be used to raise and lower containers 606, as previously described.

Tank 1604 is shown as a vessel containing a liquid coloring agent, as the previous examples. The assembly 602 is shown lowered into in tank 1604. In this configuration, second container 607 is shown in FIG. 16 as being completely submerged in tank 1604. In contrast, first container 606 is shown as only partially submerged in tank 1604.

Embodiments can also include provisions to control the amount of water entering a container. For example, container 606 and container 607 of the current embodiment include holes 680 that may be used to allow more water into container 606 and container 607. Other embodiments could incorporate any other holes in any other locations.

Furthermore, different sizes of articles are being held inside the container, which is advantageous for producing the same pattern on different sized articles in one batch. For example, the embodiment includes a first sized article 630 and a second sized article 670 retained within the same container 606.

Figure 17:
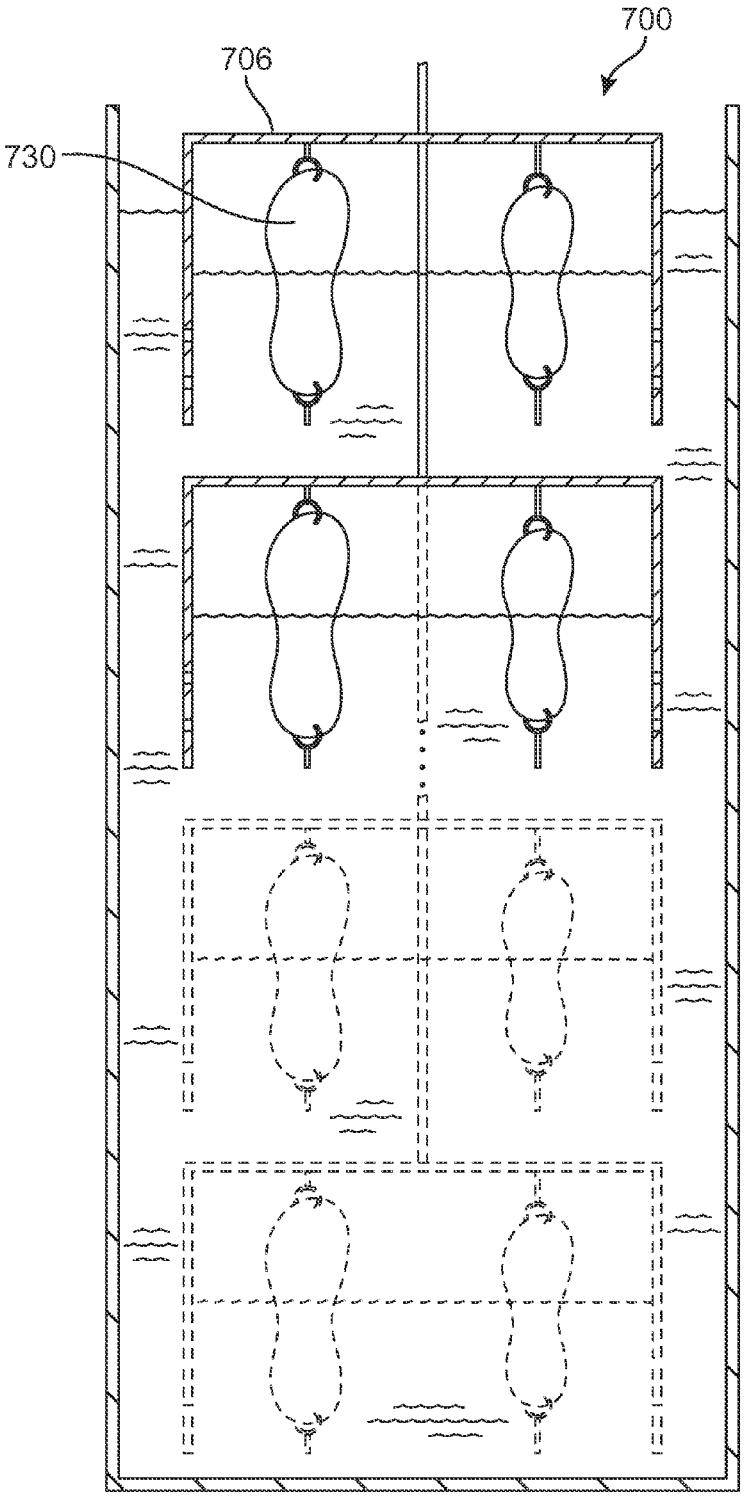
FIG. 17 is a schematic view of yet another embodiment of an apparatus used to produce multiple multicolored articles.

Although FIG. 16 illustrates an embodiment in which two containers are stacked or submerged simultaneously, other embodiments could include three or more containers. For example, FIG. 17 illustrates a schematic cross-sectional view of an assembly 700 that comprises multiple different containers 706 for holding multiple articles 730. In FIG. 17, phantom lines are used to indicate that any number of containers can be used in various embodiments.

Figure 18:
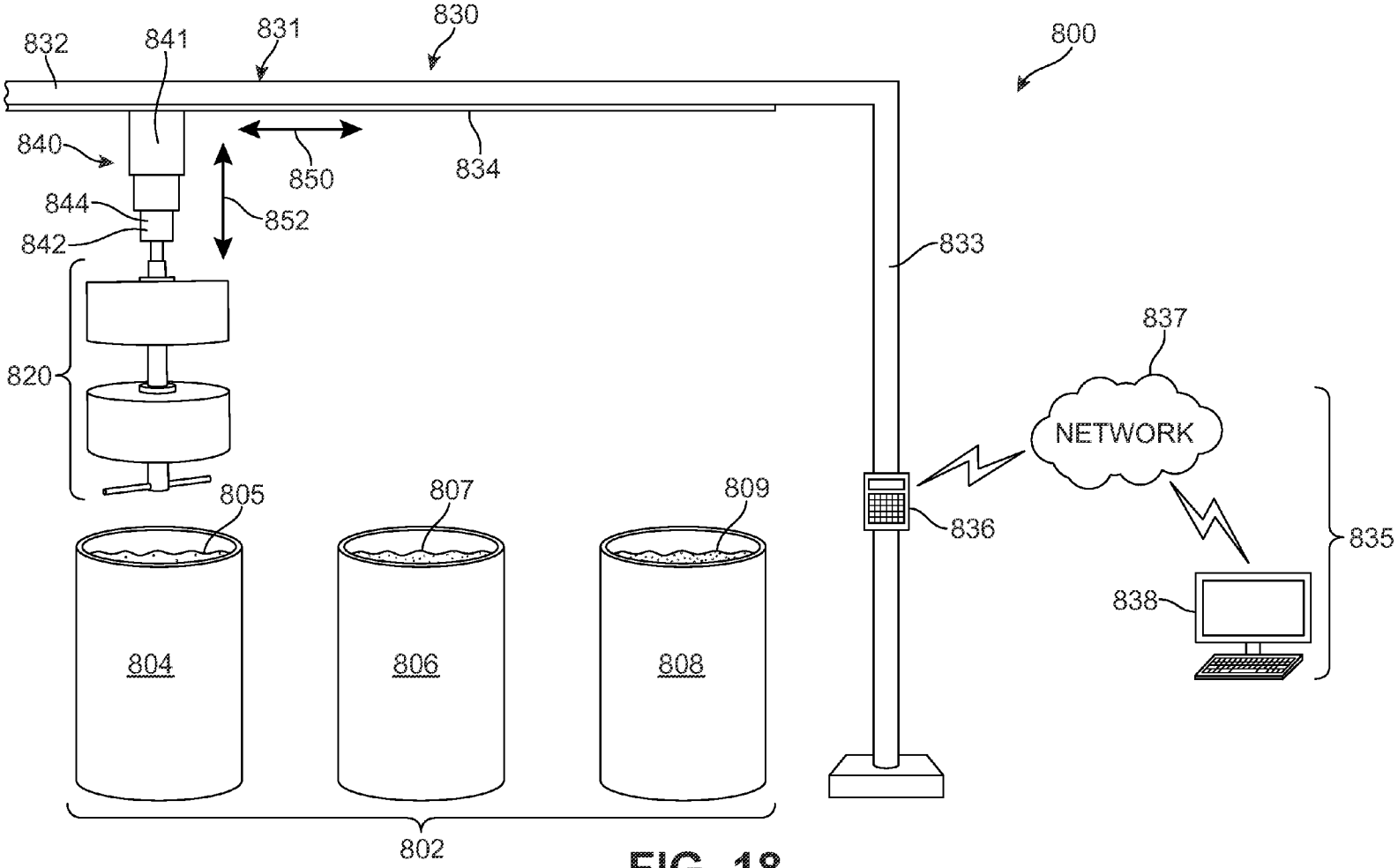
FIG. 18 is a schematic view of an embodiment of a coloring system for use in coloring articles.

FIG. 18 illustrates a schematic view of an embodiment of a coloring system 800, which may be used to color articles, such as multicolored article 100 described above and shown in FIGS. 1 and 2. Coloring system 800 may include some, but not all, features of the apparatuses discussed in previous embodiments. Moreover, in at least some embodiments, coloring system 800 can include some optional features not already discussed with respect to previous embodiments. It may be understood that any of the features specifically discussed with respect to the embodiments shown in FIGS. 18-34 may be incorporated into any of the other embodiments described in this specification. Likewise, any features discussed in previous embodiments may be incorporated into the embodiments shown in FIGS. 18-34, even when not specifically discussed.

In some embodiments, coloring system 800 includes provisions for introducing an article, such as a sole, into a liquid coloring agent. As seen in FIG. 18, coloring system 800 is comprised of various systems, assemblies, components and devices that can be used to apply coloring to (e.g., dye) some portions of an article. Specifically, coloring system 800 includes tanks 802 that hold liquid coloring agents. Coloring system 800 also includes an assembly 820 for retaining articles and an actuating system 830 to support and move assembly 820.

For purposes of illustration, tanks 802 include three tanks in the current embodiment. In this case, a first tank 804 includes a first liquid coloring agent 805, a second tank 806 includes a second liquid coloring agent 807 and a third tank 808 includes a third liquid coloring agent 809. In at least some embodiments, first liquid coloring agent 805, second liquid coloring agent 807 and third liquid coloring agent 809 may be associated with different colors.

As previously discussed, liquid coloring agents can include, but are not limited to: liquids with any kinds of coloring agents, including liquids with dyes, liquids with pigments or any other liquid based coloring agents that are known in the art. Moreover, particular dyeing methods and dye compositions that could be used with coloring system 800 have already been described above with respect to the embodiments shown in FIGS. 1-17. Although the embodiments depict a system using multiple tanks to apply multiple colors to an article, other embodiments could use different liquid agents in different tanks. For example, in methods that utilize coatings of different material characteristics (e.g., a coloring coating and a sealing coating), each coating could be provided in a different tank.

Actuating system 830 may comprise various systems and components that coordinate and implement the movement of assembly 820 into and out of tanks, as well as possibly the movement of assembly 820 between tanks. In the exemplary embodiment shown in FIG. 18, actuating system 830 includes a support structure 831. For purposes of illustration, a portion of support structure 831 is shown schematically in FIG. 18 as a horizontal overhanging beam 832 and a vertical support beam 833. In some embodiments, actuating system 830 further includes a track 834, which may be associated with overhanging beam 832.

In some embodiments, actuating system 830 includes an actuator 840. In some embodiments, actuator 840 is an electro-mechanical device that facilitates various motions of assembly 820 relative to support structure 831 and tanks 802. Actuator 840 may include a first end 841 that engages track 834 and a second end 842 that is attached to assembly 820.

Actuator 840 may be configured to facilitate various types of motions for assembly 820, including, but not limited to: translations and rotations. In some embodiments, actuator 840 can translate in an approximately horizontal manner along track 834, thereby providing horizontal movement for assembly 820 since assembly 820 is suspended from actuator 840. For purposes of clarity, this horizontal motion is indicated schematically in FIG. 18 as horizontal translation direction 850.

Additionally, in some embodiments, actuator 840 may include provisions to raise and lower assembly 820 with respect to overhanging beam 832. Such raising and lowering, or vertical translations, may be achieved by any method known in the art. In some embodiments, actuator 840 may include a telescoping portion 844 that can extend and retract, thereby changing the vertical position of second end 842 of actuator 840. Since second end 842 is engaged with assembly 820, this vertical extension or retraction can achieve the raising and lowering of assembly 820. For purposes of clarity, this vertical motion is indicated schematically in FIG. 18 as vertical translation direction 852. In at least some embodiments, actuator 840 can be used to rotate assembly 820. These rotational provisions are discussed in further detail below and shown in FIG. 30.

In some embodiments, actuating system 830 may include provisions for controlling actuator 840 and/or related systems and devices of actuating system 830. As one example of a provision for controlling actuator 840, some embodiments of actuating system 830 can include a control panel 836. In some embodiments, control panel 836 can include inputs (e.g., buttons) and outputs (e.g., displays) that allow a user to control the movement of actuator 840. Thus, for example, control panel 836 could include buttons for instructing actuator 840 to translate horizontally on track 834, buttons for raising and lowering assembly 820 and/or buttons for rotating assembly 820. Control panel 836 may also include provisions to control non-movement related systems associated with coloring system 800. For example, in some embodiments, control panel 836 could be used to control a fluid control system, which is described in further detail below.

Some embodiments of actuating system 830 may include a remote terminal 838, which can be used to control and/or program actuating system 830. In some embodiments, remote terminal 838 could be a computer system. The term "computer system" refers to the computing resources of a single computer, a portion of the computing resources of a single computer, and/or two or more computers in communication with one another, also any of these resources can be operated by one or more human users. A computing system can include, or otherwise communicate with, various kinds of storage devices including but not limited to magnetic, optical, magneto-optical, and/or memory, including volatile memory and non-volatile memory.

Some embodiments may include a network 837 to facilitate communication between remote terminal 838 and actuating system 830. Examples of networks that may be used include, but are not limited to: local area networks (LANs), networks utilizing the Bluetooth protocol, packet switched networks (such as the Internet), various kinds of wired networks, wireless networks as well as any other kinds of networks. In other embodiments, rather than utilizing an external network, remote terminal 838 and actuating system 830 could be connected directly using one or more wires or cables.

Although some exemplary mechanisms for moving assembly 820 using actuating system 830 are discussed in this detailed description, it should be understood that any suitable type of mechanism known in the art can be used to raise and lower, translate and/or rotate assembly 820. Some examples of possible of devices that could be used to actuate assembly 820 include linkages, pulley systems, ropes, cables, which could be mechanized or manual, for example.

Figure 19:
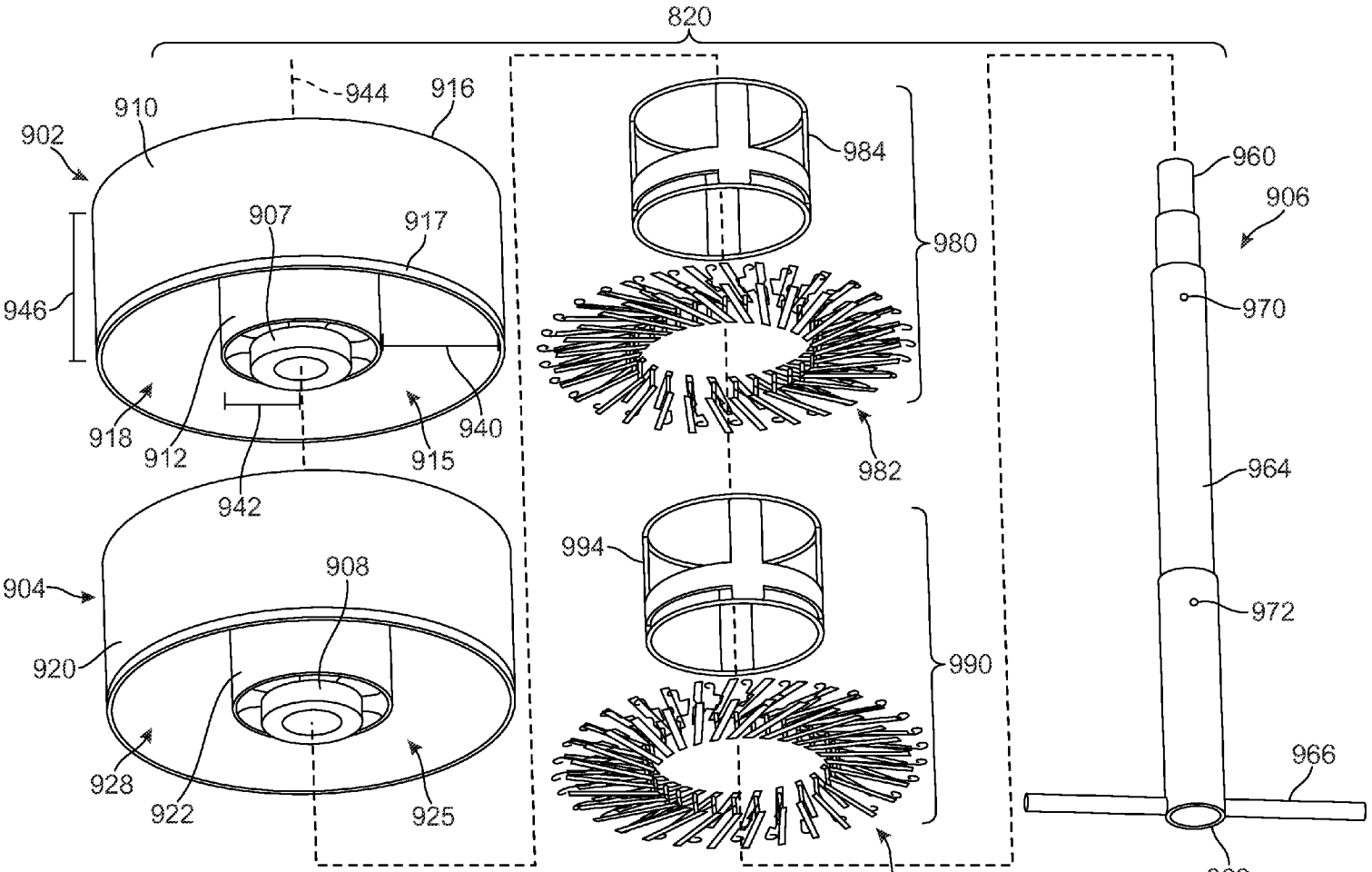
FIG. 19 is an exploded isometric view of an embodiment of an assembly for use in retaining and coloring articles.
Figure 20:
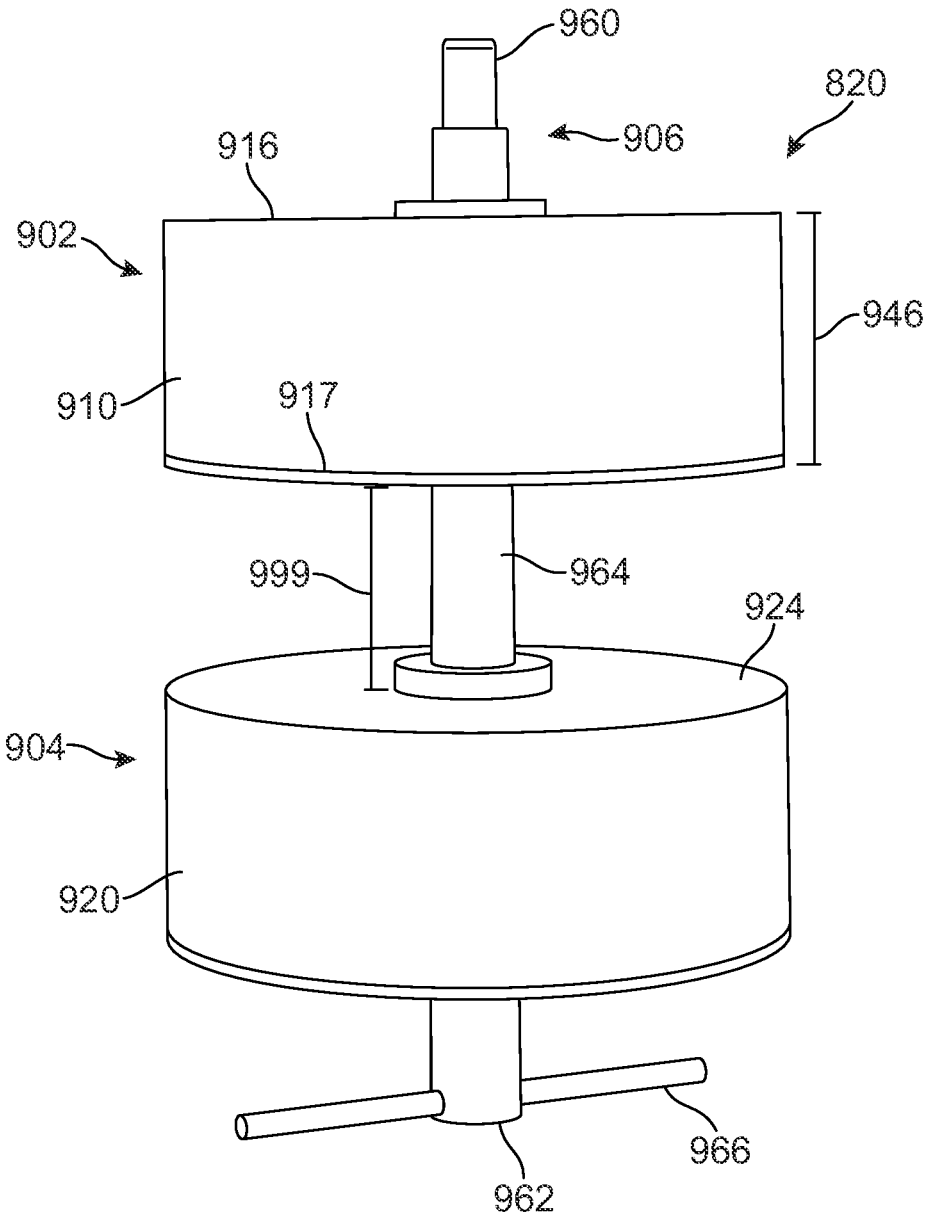
FIG. 20 is a schematic front isometric view of an embodiment of an assembly.
Figure 21:
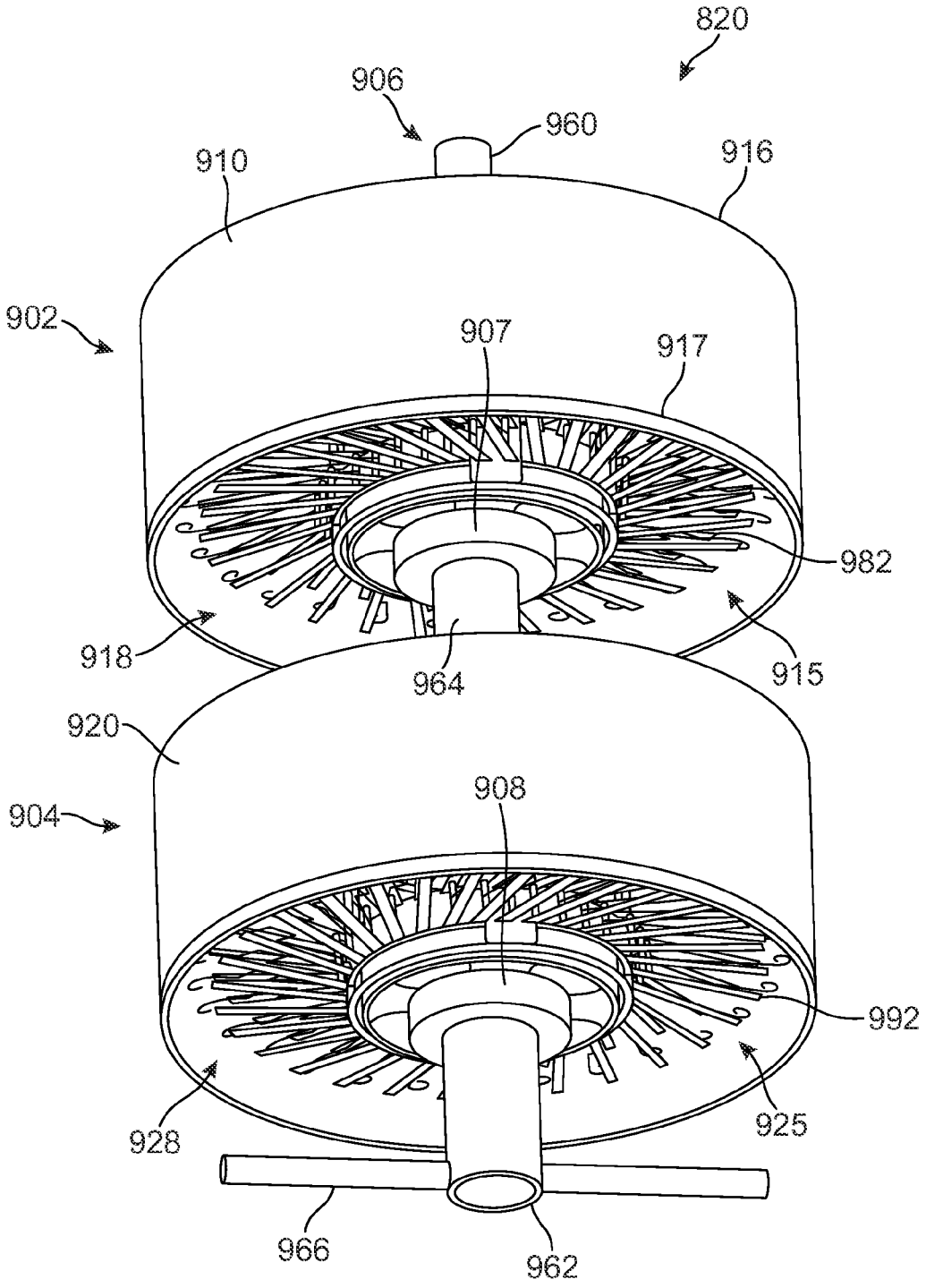
FIG. 21 is a schematic bottom isometric view of an embodiment of an assembly.
Figure 22:
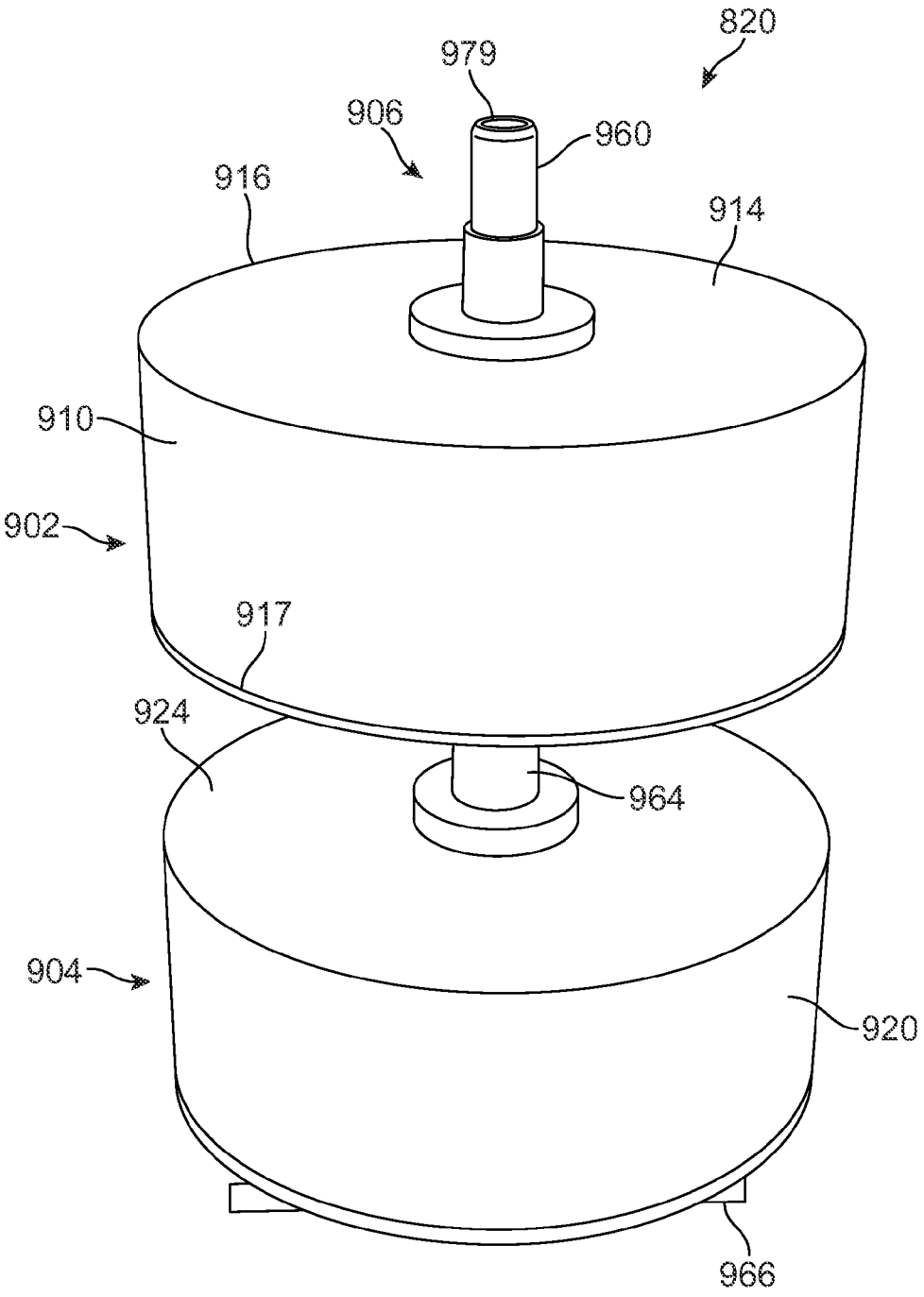
FIG. 22 is a schematic top isometric view of an embodiment of an assembly.

FIG. 19 illustrates a schematic isometric exploded view of assembly 820. FIGS. 20-22 illustrate various schematic isometric views of assembly 820. Referring now to FIGS. 19 through 22, assembly 820 may include containers for retaining articles. In particular, in the exemplary embodiment, assembly 820 includes a first container 902 and second container 904. Although the exemplary embodiment illustrates an assembly comprising two containers, other embodiments could use a single container or more than two containers.

Each container may be associated with an outer side wall, an inner side wall and a top wall. For example, first container 902 may include an outer side wall 910, an inner side wall 912 and a top wall 914. As best shown in FIG. 19, outer side wall 910, inner side wall 912 and top wall 914 may enclose an interior region 915 of first container 902. While top wall 914 may be disposed at a first end portion 916 of container 902, so that container 902 is closed at the top, a second end portion 917 of container 902 may be open. Specifically, an opening 918 of container 902 provides access to interior region 915. Second container 904 make include a similar outer wall 920, inner side wall 922 and top wall 924, which together with an opening 928, define an interior region 925.

In different embodiments, the geometry of first container 902 and second container 904 could vary. Generally, the exterior geometry of a container may be defined by its outer walls and top wall, while the geometry of an interior region may be defined by both its outer walls and its inner walls. In the exemplary embodiment shown in the figures, the exterior of first container 902 has an approximately cylindrical shape. In some embodiments, the geometry of interior region 915 has the geometry of a rectangular toroid. Moreover, in an exemplary embodiment, second container 904 may have a substantially similar geometry to first container 902. In other embodiments, of course, first container 902 and second container 904 could have substantially different geometries.

In different embodiments, the size of each container could vary. Generally, the size of each container may be selected so that the container can receive a particular number of articles simultaneously. Specifically, the interior dimensions of each container may be selected to achieve a particular size and volume for an interior region, where the articles are retained during submersion of assembly 820 in liquid. In an exemplary embodiment, the radial distance between the outer wall and the inner wall of a container may be large enough to receive an article widthwise. For example, referring to FIG. 19, a radial distance 940 between outer wall 910 and inner wall 912 of first container 902 may be substantially larger than the width of an article inserted into first container 902. Moreover, the total number of articles that can be inserted into an interior region of a container will vary with the interior radius of the container (e.g., the radial distance from a central axis of the container to its inner wall). For example, the number of articles that can be inserted into first container 902 may vary with inner radius 942 of first container 902, which extends between central axis 944 of first container 902 and inner wall 912.

The height of each container may also be varied to achieve full or partial covering of articles disposed within the container. In some embodiments, for example, first container 902 has a height 946 that is substantially greater than the length of a typical article (such as a sole), thereby allowing all of the article to be retained within interior region 915. As an example, in embodiments where a typical sole used with assembly 820 has a maximum length of approximately 12½ inches (e.g., the approximate length of a U.S. footwear size 16), height 946 may be at least 12½ inches. In other embodiments, height 946 could be varied in any manner to accommodate the maximum length of articles intended for use with assembly 820. However, in other embodiments, height 946 may be such that at least some portions of an article fastened within first container 902 extends outside of interior region 915 (i.e., the article extends past second end portion 917 of first container 902). It will be understood that the height of second container 904 could also be varied in a similar manner. In at least some embodiments, first container 902 and second container 904 may have substantially identical heights.

In order to support first container 902 and second container 904 and hold these containers in a fixed relation to one another, assembly 820 may include a central support member 906. In some embodiments, central support member 906 comprises a bar, rod or tube-like member. In other words, in at least some embodiments, central support member 906 has an approximately cylindrical exterior geometry.

Central support member 906 may be characterized as having a first end 960, a second end 962 and an intermediate portion 964. Intermediate portion 964 may extend between first end 960 and second end 962.

In some embodiments, central support member 906 may include one or more openings. For example, as shown in the embodiment of FIG. 19, central support member 906 includes a first opening 970 and a second opening 972, which are disposed on intermediate portion 964 in the approximate locations corresponding to first container 902 and second container 904, respectively. In some embodiments, first opening 970 and second opening 972 could be in fluid communication with an opening 979 at first end 960 of central support member 906 (see FIG. 22). Moreover, in some embodiments, a hollow interior cavity of central support member 906, or other fluid channel within central support member 906, could provide means for the fluid communication between first opening 970, second opening 972 and opening 979.

In at least some embodiments, second end 962 of central support member 906 may be further associated with a lower support member 966. Lower support member 966 may generally extend in a perpendicular manner to central support member 906. In some embodiments, lower support member 966 could be used to facilitate mixing of liquid when assembly 820 is rotated within a tank of liquid. In other embodiments, lower support member 966 may include provisions to further facilitate the movement of fluid into and/or out of first container 902 and second container 904 of assembly 820.

As best illustrated in FIG. 19, assembly 820 may include one or more fastening assemblies. Specifically, assembly 820 may include first fastening assembly 980 and second fastening assembly 990. Each fastening assembly may further include a plurality of fastening structures and a support frame that connects the fastening structures with a corresponding container. In the exemplary embodiment, assembly 820 includes a first plurality of fastening structures 982 and a first support frame 984 that connects first plurality of fastening structures 982 to the interior of first container 902. Likewise, a second plurality of fastening structures 992 are connected to the interior of second container 904 by a second support frame 994.

When assembled together, first container 902 and second container 904 are mounted to central support member 906 so that first container 902 and second container 904 are spaced apart from one another. As clearly shown in FIG. 20, first container 902 is disposed nearer to first end 960 of central support member 906, while second container 904 is disposed nearer to second end 962 of central support member 906. The spacing between first container 902 and second container 904, indicated in FIG. 20 as spacing 999, can be selected to ensure that there is enough clearance to insert articles into opening 918 of first container 902. Thus, in at least some embodiments, spacing 999 may be larger than, or approximately equal to, the largest possible length of an article that may be used with assembly 820. For example, in embodiments where articles used with assembly 820 may have a maximum length of approximately 12½ inches (for a U.S. size 16 shoe), spacing 999 may be greater than or equal to 12½ inches. Of course, spacing 999 could be larger in embodiments where articles may have typical lengths greater than 12 inches, and generally spacing 999 could be selected to have any value.

In some embodiments, the mounting of first container 902 and second container 904 to central support member 906 is achieved using mounting structures that are radially inwards of an inner wall of each container. For example, first container 902 may include a mounting structure 907 that is disposed radially inwards of inner wall 912, which facilitates the mounting of first container 902 to central support member 906. A similar mounting structure 908 may likewise be used to attach second container 904 to central support member 906.

Fastening assembly 980 and fastening assembly 990 may be mounted within the interiors of first container 902 and second container 904, respectively. Specifically, first fastening assembly 980 may be mounted to inner wall 912 of first container 902, while second fastening assembly 990 may be mounted to inner wall 922 of second container 904. As discussed in further detail below, in some embodiments each fastening assembly may be mounted in a manner that allows the corresponding fastening structures to be raised and lowered within the interior of each container. In other words, first plurality of fastening structures 982 may be raised and lowered within interior region 915 of first container 902, while second plurality of fastening structures 992 may be raised and lowered within interior region 925 of second container 904.

Figure 23:
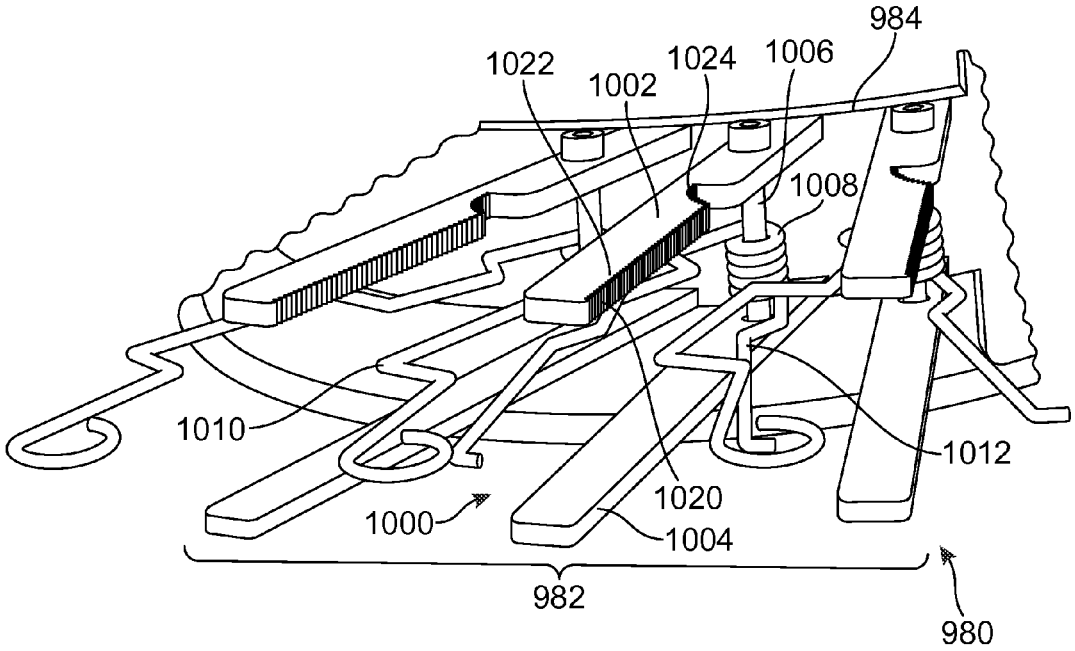
FIG. 23 is a schematic isometric view of an embodiment of several fastening structures used with an assembly.
Figure 24:
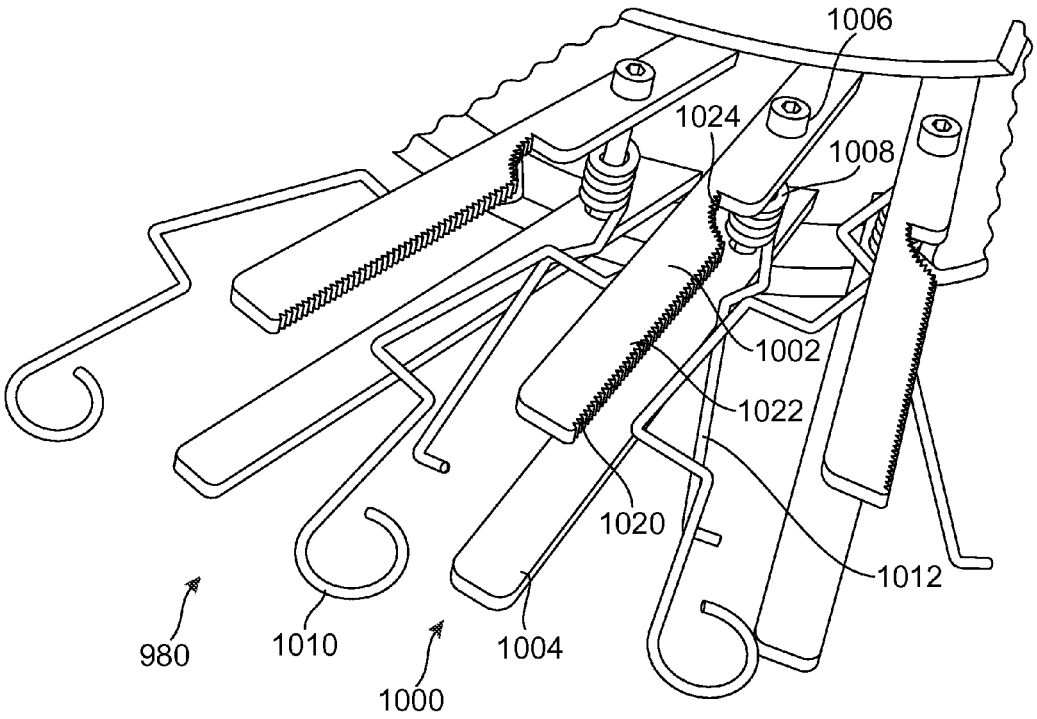
FIG. 24 is a top isometric view of the fastening structures of FIG. 23.

Details of the fastening structures are discussed in reference to FIGS. 23 and 24, which illustrate detailed isometric views of several fastening structures of first fastening assembly 980. Referring now to FIGS. 23 and 24, each fastening structure is comprised of multiple distinct components. For example, a first fastening structure 1000 includes an upper fastening bar 1002 and a lower fastening bar 1004.

Upper fastening bar 1002 and lower fastening bar 1004 each have approximately rectangular geometries. Moreover, upper fastening bar 1002 and lower fastening bar 1004 each extend approximately radially outwards from first support member 984 of first fastening assembly 980. As best seen in FIG. 24, upper fastening bar 1002 is positioned approximately over, or parallel to, lower fastening bar 1004.

A connecting member 1006 extends between upper fastening bar 1002 and lower fastening bar 1004, connecting the bars at their inner most, or proximal, ends. A spring clip member 1008 is engaged around connecting member 1006 and includes a first clip end 1010 and a second clip end 1012.

Some embodiments of fastening structures may incorporate further provisions to ensure an article is securely fastened, or retained within a container. In some embodiments, at least one fastening bar may include teeth on a side edge to further engage a portion of an article. For example, as shown in FIGS. 23-24, upper fastening bar 1002 includes teeth 1020 on a side edge 1022. Additionally, in the exemplary embodiment, fastening bar 1002 includes a notch 1024 that may further help to retain portions of an article. For example, in at least some embodiments, an edge of an article may be engaged with notch 1024 to reduce the tendency of the article to slip from fastening structure 1000.

While the above description is for first fastening structure 1000, it will be understood that in at least some embodiments, each of the remaining fastening structures of first fastening assembly 980 and second fastening assembly 990 may be substantially similar to first fastening structure 1000. Of course, in other embodiments, two or more fastening structures could vary in any manner and could be substantially different. Moreover, the type of fastening structures used to retain articles could vary according to the number and types of articles intended to be used with assembly 820.

Using this configuration, fastening structures may be used to temporarily retain, or fix in place, multiple articles within each container while assembly 820 is placed in liquid.

Figure 25:
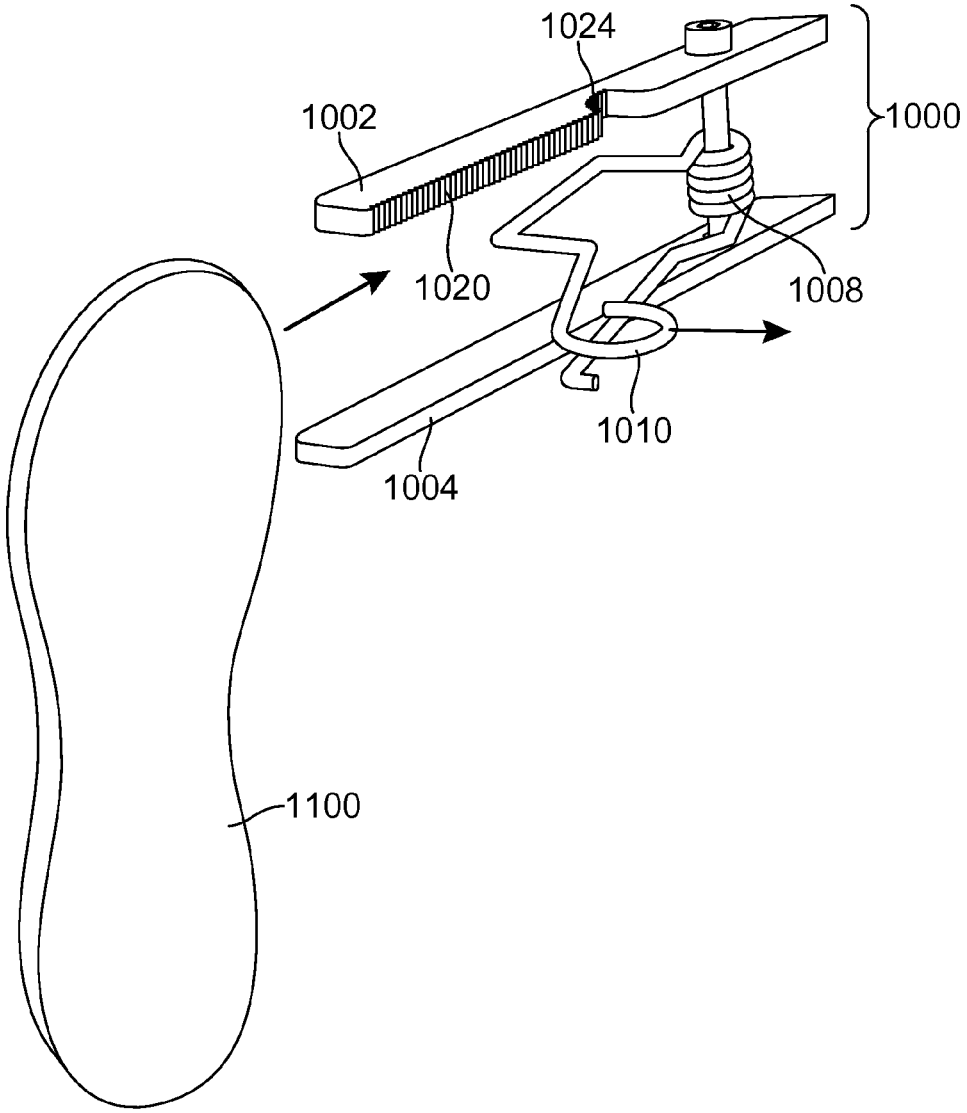
FIG. 25 is a schematic isometric view of a step in fastening an article to a fastening structure, according to an embodiment.
Figure 26:
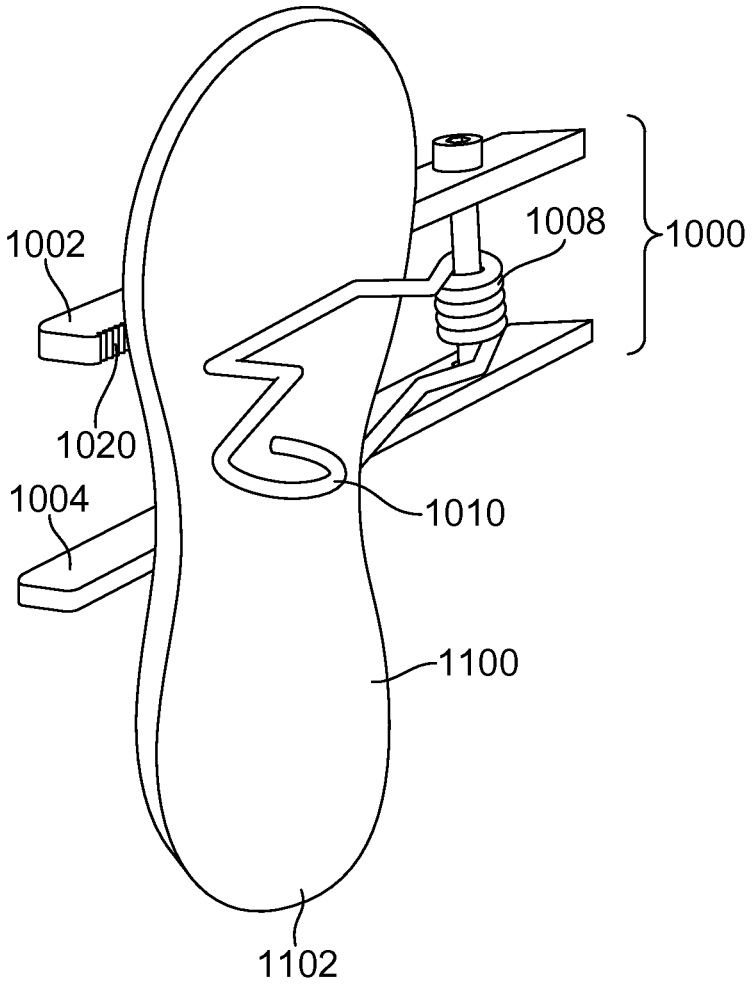
FIG. 26 is a schematic isometric view of the article of FIG. 25 fastened to the fastening structure.

FIGS. 25-26 illustrate schematic isometric views of fastening an article in place using a fastening structure. Referring to FIGS. 25-26, article 1100, in the form of a sole for footwear, is associated with fastening structure 1000. As seen in FIG. 25, first clip end 1010 may be pulled away from upper fastening bar 1002 and lower fastening bar 1004, while article 1100 is placed between first clip end 1010 and upper fastening bar 1002 and lower fastening bar 1004. As shown in FIG. 26, when first clip end 1010 is released, spring clip member 1008 acts to fasten article 1100 against upper fastening bar 1002 and lower fastening bar 1004. Specifically, first clip end 1010 may be pressed into a first side 1102 of article 1100, and may push against article 1100 so that a second side (not shown) of article 1100 is pressed against upper fastening bar 1002 and lower fastening bar 1004. Moreover, in at least some embodiments, teeth 1020 of upper fastening bar 1002 may increase the traction of upper fastening bar 1002 against article 1100, thereby reducing any tendency for article 1100 to slip out of fastening structure 1000.

In some embodiments, fastening structures may be positioned adjacent to the opening of a container to facilitate easy fastening of articles. For example, as best shown in FIG. 21, first plurality of fastening structures 982 may be disposed adjacent to opening 918 of first container 902 and second plurality of fastening structures 992 may be disposed adjacent to opening 928 of second container 904, prior to the fastening of articles to assembly 820. This configuration allows an operator to easily access the fastening structures without having to reach into first container 902 and second container 904, thereby improving ease of use and reducing the time required to fasten and unfasten articles.

Figure 27:
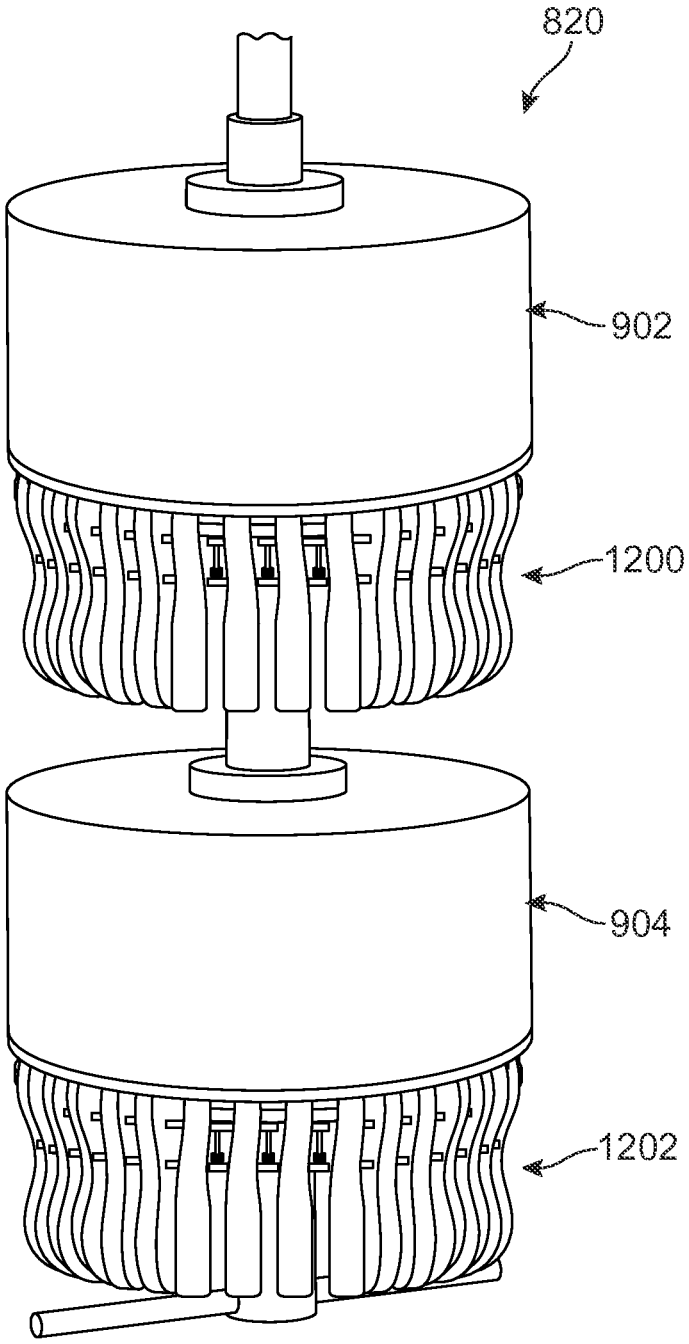
FIG. 27 is a schematic isometric view of an embodiment of an assembly with a plurality of articles fastened within the assembly.

FIG. 27 illustrates an isometric view of assembly 820 after a plurality of articles 1200 and a second plurality of articles 1202, in the form of soles for footwear, have been fastened within first container 902 and second container 904, respectively. In this fully extended configuration for the articles, first plurality of articles 1200 are hanging down from first container 902 and are primarily disposed outside of interior region 915. Likewise, second plurality of articles 1202 are hanging down from second container 904 and are primarily disposed outside of interior region 925.

Figure 28:
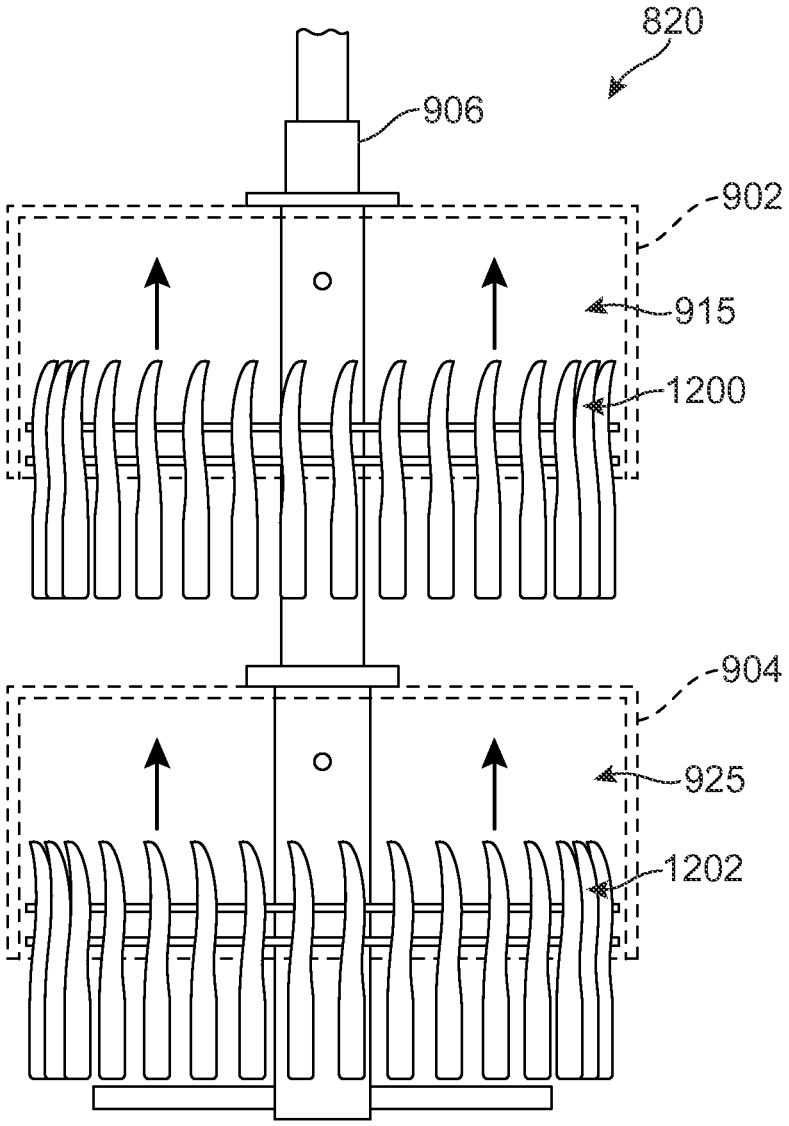
FIG. 28 is a schematic side view of a plurality of articles being raised into the containers of an assembly, according to an embodiment.
Figure 29:
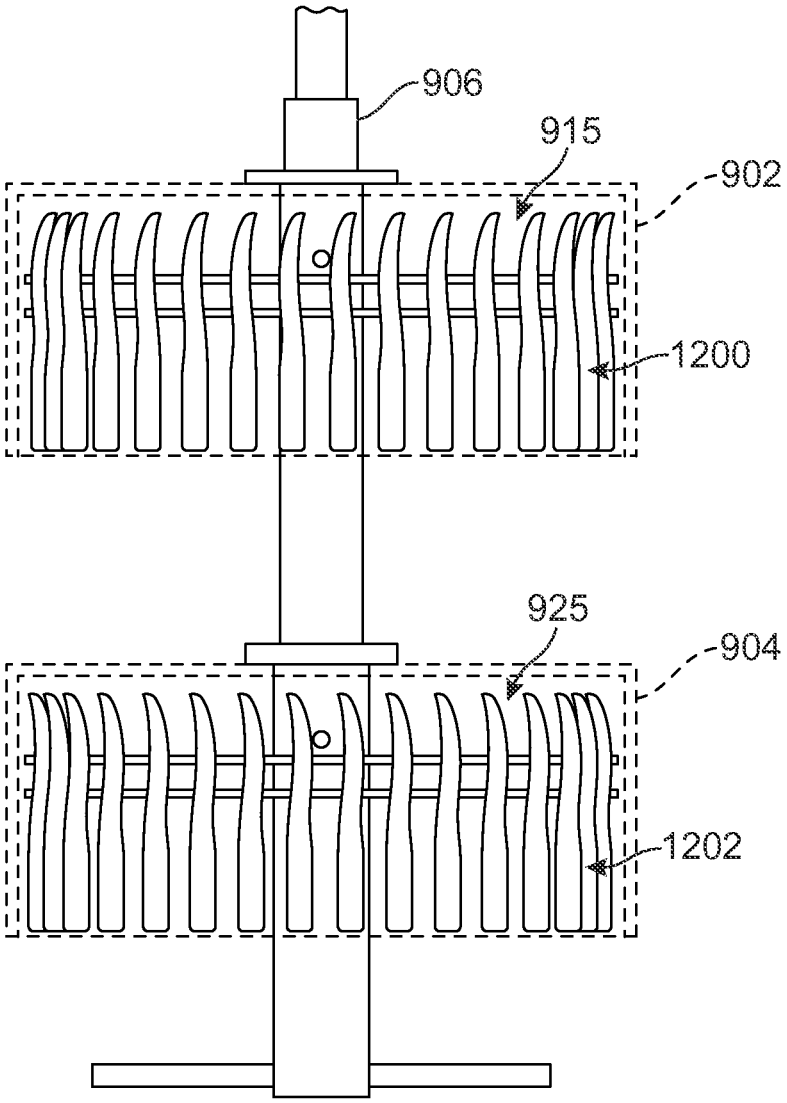
FIG. 29 is a schematic side view of a plurality of articles fully retained within the containers of an assembly, according to an embodiment.

FIGS. 28 and 29 illustrates side schematic views of first plurality of articles 1200 being retracted into interior 915 of first container 902 and second plurality of articles 1202 being retracted into interior 925 of second container 904. In an exemplary embodiment, a fully retracted configuration for first plurality of articles 1200 and second plurality of articles 1202, shown in FIG. 29, may be one where first plurality of articles 1200 are completely disposed within interior 915 of first container 902 and second plurality of articles 1202 are completely disposed within interior 925 of second container 904. In other embodiments, however, first plurality of articles 1200 and/or second plurality of articles 1202 may not be fully enclosed in interior regions of the corresponding containers, even in a maximally retracted configuration for assembly 820.

In different embodiments, the mechanisms used to retract fastening structures further into the interior of each container may vary. In some embodiments, fastening structures may be mounted to a corresponding support frame in a manner that allows the fastening structures to slide from a lower end to an upper end of the support frame. In some cases, the fastening structures could be manually retracted by an operator, either by moving the fastening structures directly, or by moving the articles, which further move the fastening structures along the support frame. In other cases, an automated mechanism could be used to raise and lower the fastening structures along the support frame. In still other cases, the fastening structures may be configured to retract as the articles are submerged in a tank filled with liquid, since the buoyancy of the articles may act to lift the articles and the fastening structures up into the container.

In still other embodiments, however, the fastening structures could be fixed in place within the interior of a container. In such embodiments, it is contemplated that some portions of the container may be removable. Thus, an operator can remove portions of the container to expose the fastening structures to facilitate easy access to the fastening structures. In still other embodiments, it is contemplated that the fastening structures may be fixed in place relative to the central support member, and the container may be raised and lowered to expose the fastening structures along the opening of the container.

Figure 30:
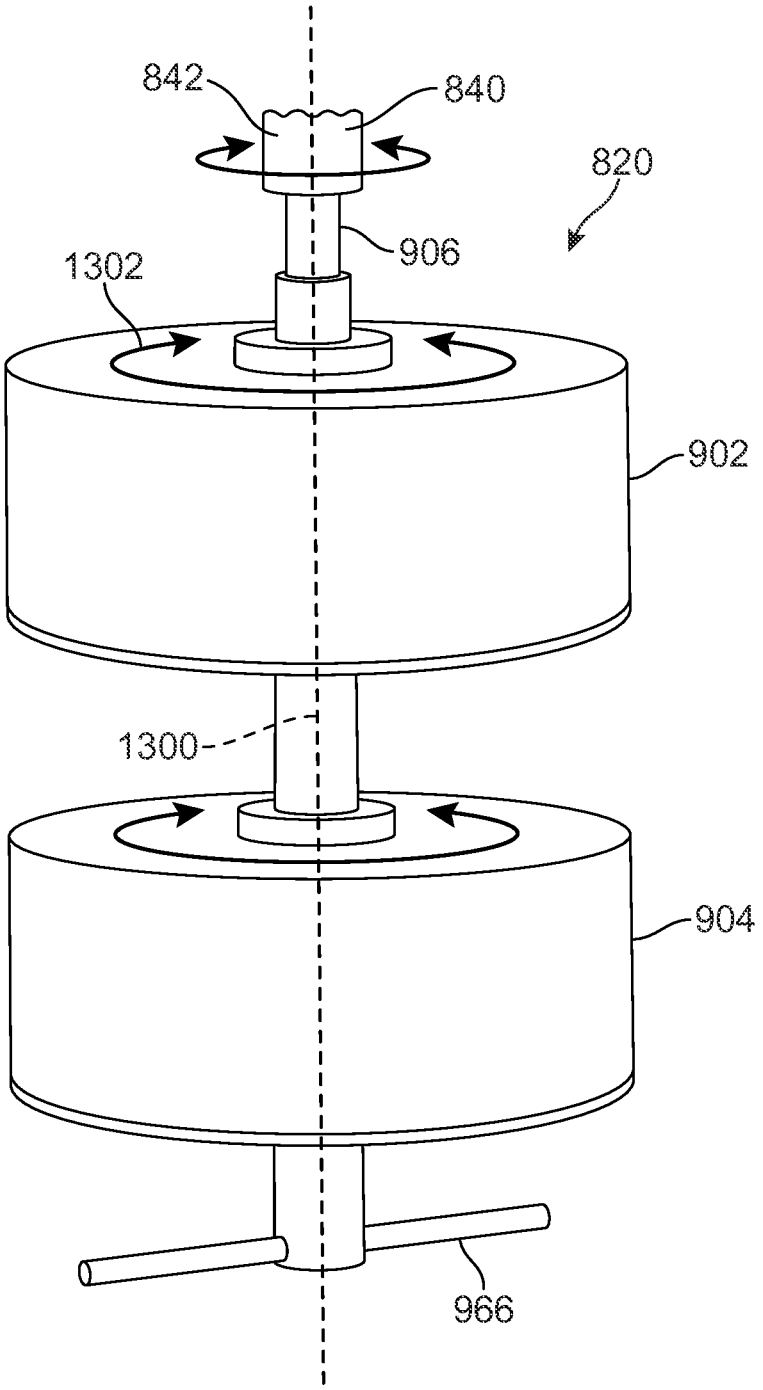
FIG. 30 is a schematic isometric view of an embodiment of an assembly configured to undergo rotations.

As previously discussed, in some embodiments an actuator may facilitate the rotation of an assembly. Referring to FIG. 30, which illustrates some portions of coloring system 800, actuator 840 may be capable of rotating assembly 820 in a clockwise or counterclockwise direction. Specifically, end portion 842 of actuator 840, which is connected to assembly 820, may be rotatable. As end portion 842 rotates, assembly 820 is likewise rotated about a central axis 1300 of central support member 906. As assembly 820 is rotated, articles fastened within first container 902 and second container 904 may also rotate about central axis 1300. The rotational motions available to assembly 820 are indicated schematically in FIG. 30 as rotations 1302.

In some embodiments, central axis 1300 may also be parallel with the direction of vertical translations accomplished via actuator 840. In other words, assembly 820 may be raised and lowered along the direction of central axis 1300, and assembly 820 may also be rotated about central axis 1300.

Rotating assembly 820 may increase operating efficiency by allowing an operator to stand in a single location during loading of the articles. Specifically, an operator can load articles into a set of fastening structures that are in front of them, then the operator can rotate the assembly to load articles into a different set of fastening structures. Moreover, in at least some embodiments, assembly 820 may be rotated while first container 902 and second container 904 are submerged in a liquid, thereby allowing rotating components of assembly 820 to mix the liquid to improve the integrity of the dyeing process (e.g., by ensuring the liquid coloring agent remains well mixed throughout the dyeing process).

Embodiments can include provisions to adjust the volume of gas (e.g., air) within a container when the container is submerged within a tank. In some embodiments, a coloring system can include a fluid control system. A fluid control system may include one or more openings, valves, fluid lines, fluid pumps and/or other systems and components that facilitate the control of fluid to and/or from a container.

Figure 31:
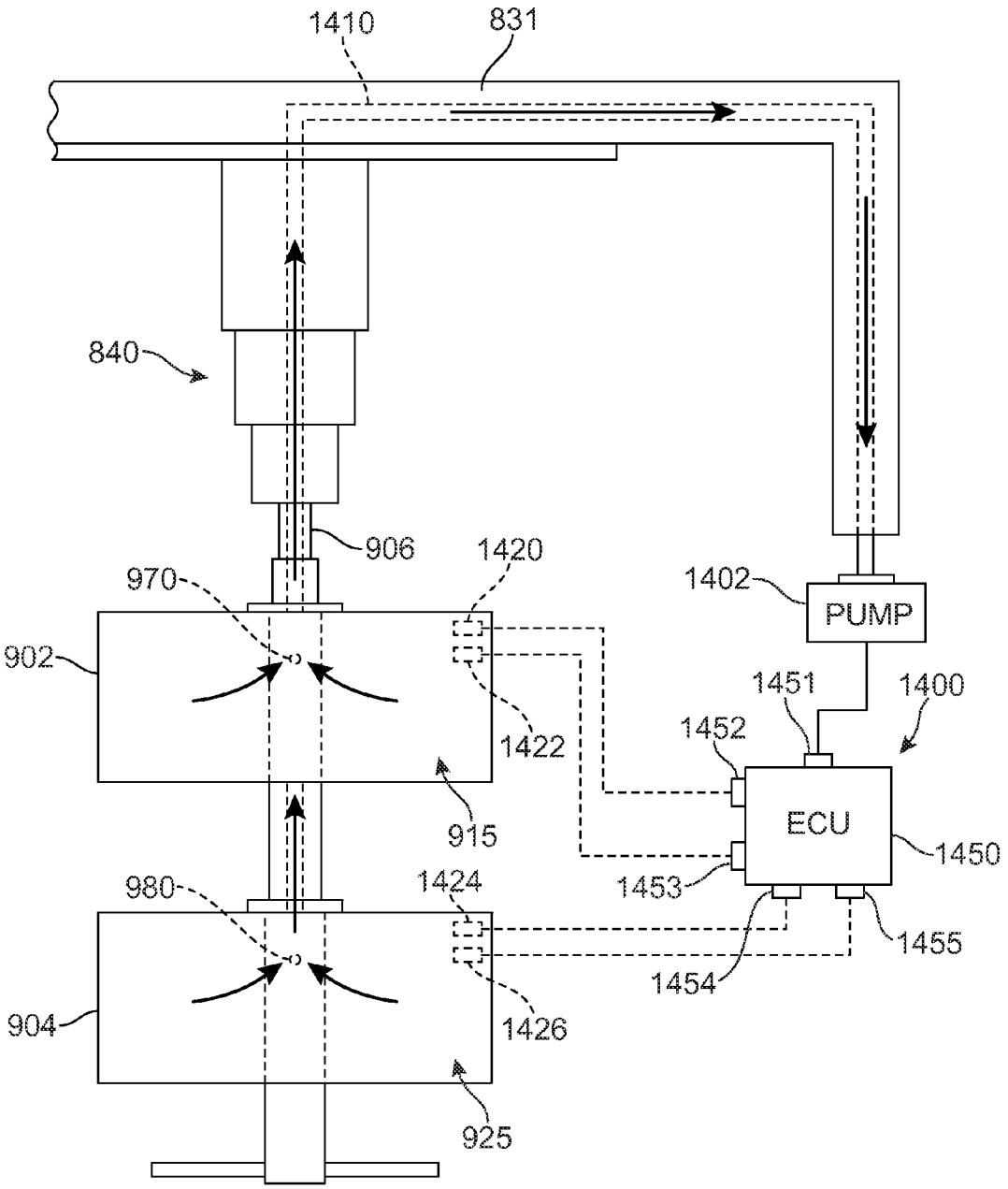
FIG. 31 is a schematic view of an embodiment of portions of a coloring system, including a fluid control system.

FIG. 31 illustrates a schematic view of some components of a fluid control system 1400 for coloring system 800. For purposes of illustration, only some possible components of fluid control system 1400 are shown in FIG. 31. Referring to FIG. 31, fluid control system 1400 includes a fluid pump 1402 that may be in fluid communication with first opening 970 and second opening 972 of central support member 906. In some embodiments, fluid from first opening 970 and second opening 972 may travel through an interior fluid channel within central support member 906 (e.g., a hollow interior cavity), out of opening 979 (see FIG. 22) of central support member 906 and into a fluid line 1410. In some embodiments, fluid line 1410 may extend through actuator 840 and along support structure 831 to fluid pump 1402. With such a configuration, fluid may be pulled from interior region 915 of first container 902 and interior region 925 of second container 904 by fluid pump 1402. Of course, in some embodiments, fluid pump 1402 could also be used to pump additional fluid into interior region 915 of first container 902 and interior region 925 of second container 904, thereby increasing the volume of air or gas within each container when the containers are partially filled with liquid.

In at least some embodiments, each container may include one or more openings or channels that allow fluid to pass from openings in central support member 906 to an interior region of the container. For example, although not illustrated in FIG. 31, some embodiments of assembly 820 include additional openings in inner wall 912 of first container 902 that facilitate fluid communication between first opening 970 of central support member 906 and interior region 915 of first container 902 (see FIG. 19). Likewise, some embodiments could include additional openings in inner wall 922 of second container 904 that facilitate fluid communication between second opening 972 of central support member 906 and interior region 925 of second container 904 (see FIG. 19). Moreover, it will be understood that other embodiments may utilize any combination of openings, channels, cavities, fluid lines or other fluid transferring components, devices or systems in order to place the interior regions of each container in fluid communication with a fluid pump.

In some embodiments, fluid control system 1400 may incorporate one or more valves, or vents, associated with, for example, first opening 970 and second opening 972. Valves or vents may be used to actively or passively control the flow of fluid into or out of the interior regions of first container 902 and second container 904.

In some embodiments, fluid pump 1402 may be in communication with, and controlled by, an electronic control unit 1450, also referred to simply as ECU 1450. ECU 1450 may include a microprocessor, RAM, ROM, and software all serving to monitor and control various components of fluid control system 1400, as well as other components or systems of coloring system 800. For example, ECU 1450 is capable of receiving signals from numerous sensors, devices, and systems associated with fluid control system 1400. The output of various devices is sent to ECU 1450 where the device signals may be stored in an electronic storage, such as RAM. Both current and electronically stored signals may be processed by a central processing unit (CPU) in accordance with software stored in an electronic memory, such as ROM.

Some embodiments of fluid control system 1400 can utilize one or more sensors. Exemplary sensors include, but are not limited to, pressure sensors, fluid level sensors, air flow sensors, temperature sensors, air mass sensors as well as possibly other kinds of sensors. In an exemplary embodiment, first container 902 includes a pressure sensor 1420 and a fluid level sensor 1422. Pressure sensor 1420 and fluid level sensor 1422 may be positioned within interior region 915. When first container 902 is submerged in liquid, pressure sensor 1420 may be used to detect information related to the pressure within any air pocket inside of first container 902. Also, when first container 902 is submerged in liquid, fluid level sensor 1422 may be capable of detecting information related to the level of the liquid within interior region 915. The level of the liquid may be the vertical position of the liquid within interior region 915, which may be measured relative to the vertical position of second end portion 917 of first container 902.

Similarly, in some embodiments, second container 904 may include pressure sensor 1424 and a fluid level sensor 1426. Further, pressure sensor 1424 and fluid level sensor 1426 may be operable to determine the pressure of an air pocket in second container 904 and the level of liquid inside of second container 904, respectively, when second container 904 is submerged in liquid.

ECU 1450 may include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 1450 are optional. Some embodiments may include a given port or provision, while others may exclude it. The following description discloses many of the possible ports and provisions that can be used, however, it should be kept in mind that not every port or provision must be used or included in a given embodiment.

ECU 1450 may communicate with fluid pump 1402 via port 1451. Also, ECU 1450 may communicate with pressure sensor 1420 and fluid level sensor 1422 via port 1452 and port 1453, respectively. Likewise, ECU 1450 may communicate with pressure sensor 1424 and fluid level sensor 1426 via port 1454 and port 1455, respectively.

Figure 32:
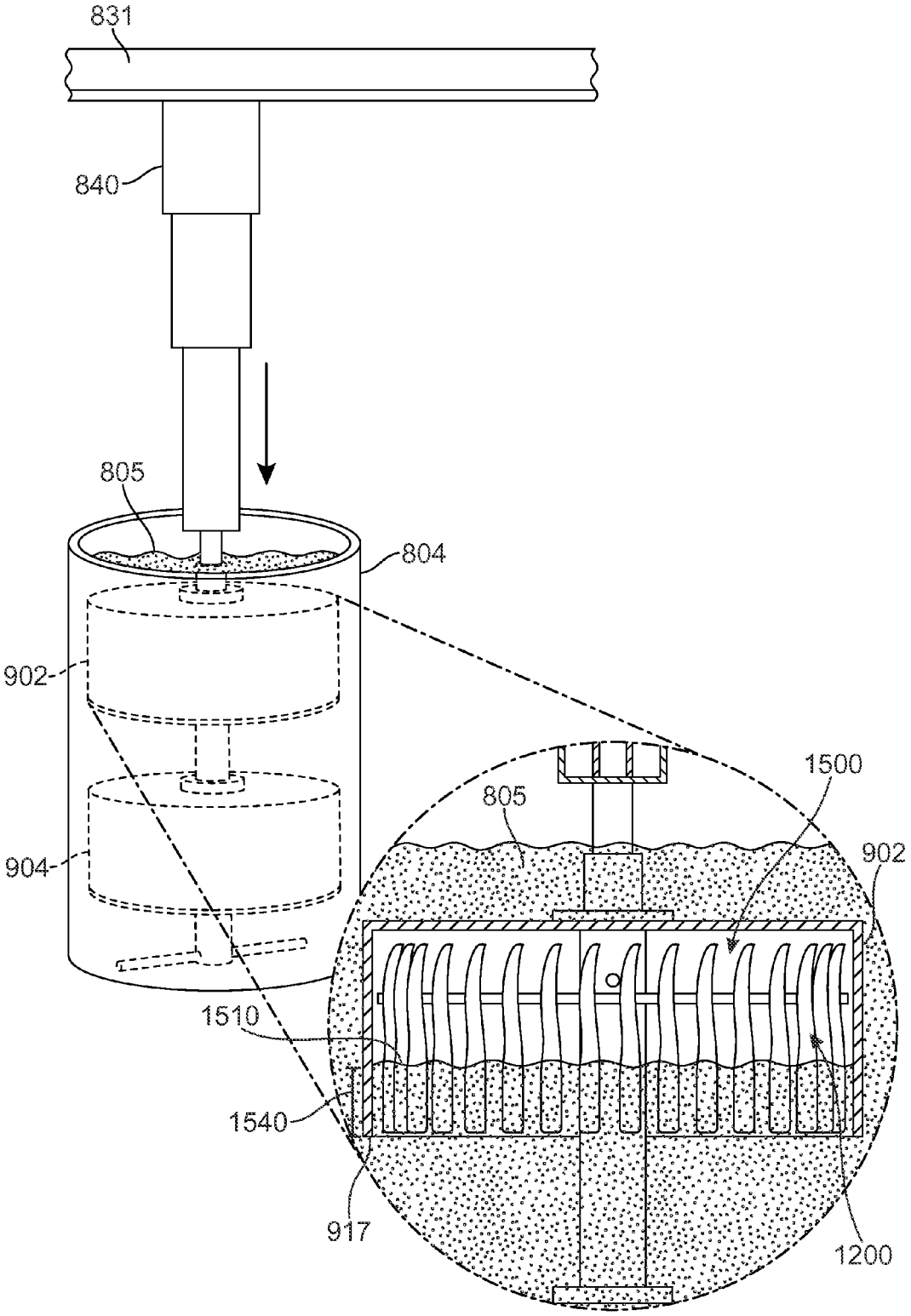
FIG. 32 is a schematic isometric view of an embodiment of an assembly introduced within a tank filled with a liquid coloring agent.
Figure 33:
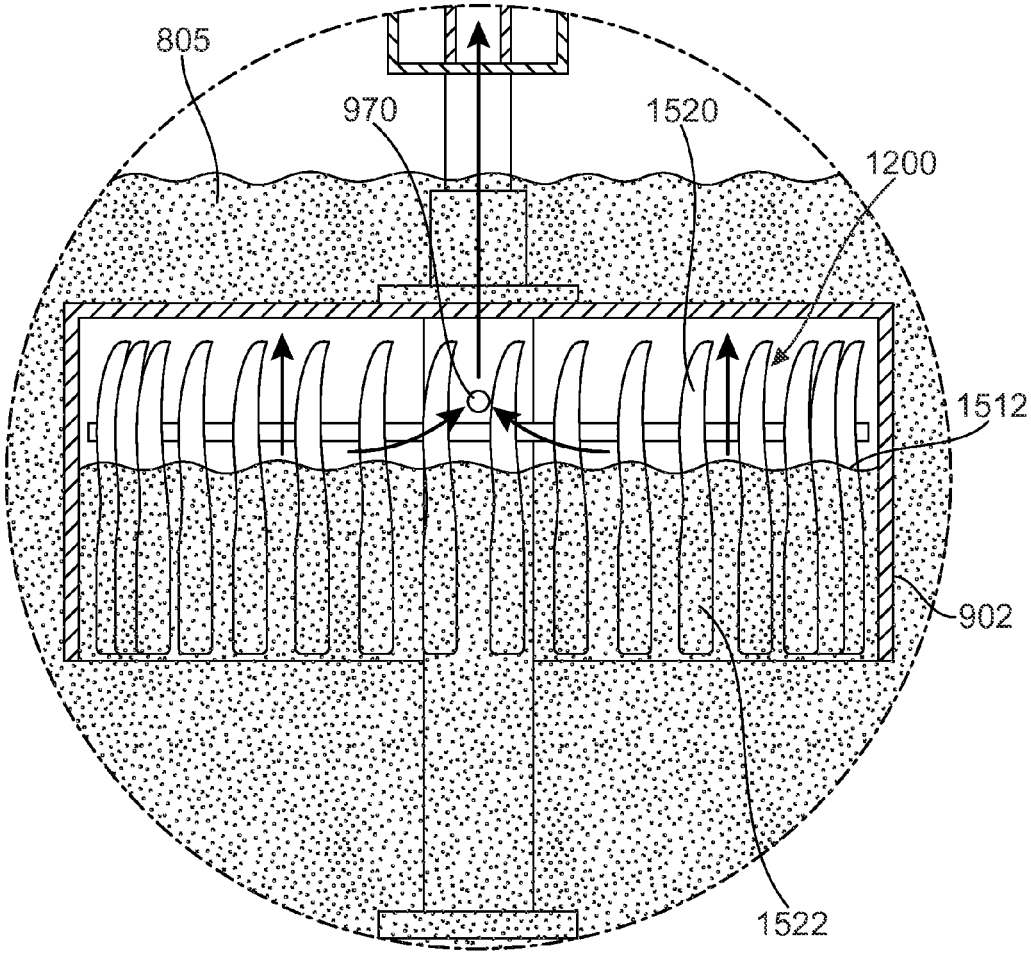
FIG. 33 is a side cross-sectional view of a container disposed within a liquid coloring agent, according to an embodiment.
Figure 34:
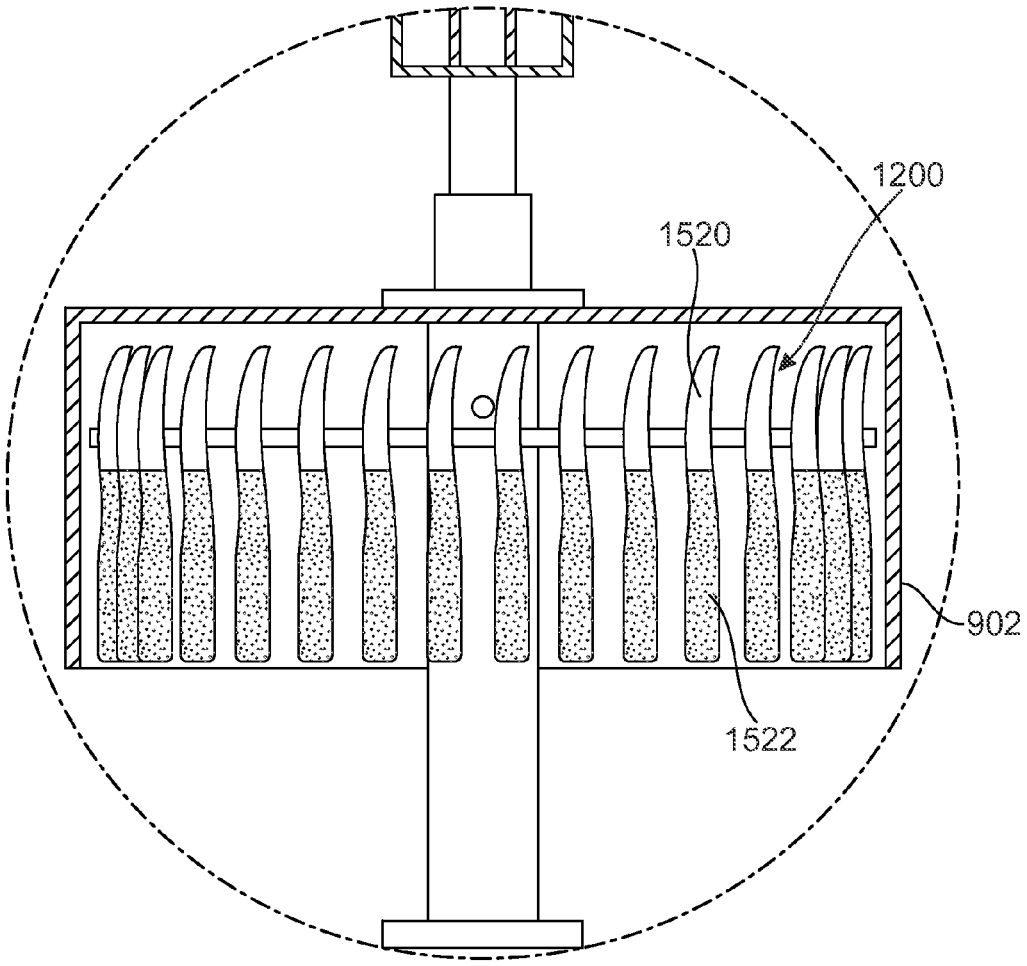
FIG. 34 is a side cross-sectional view of a container with partially colored articles, according to an embodiment.

FIGS. 32 through 34 illustrate several schematic views of a sequence comprising a part of a method of coloring articles using coloring system 800. In particular, FIGS. 32 through 34 illustrate a method for adjusting the volume of the air pocket within the containers of assembly 820 in order to color precise regions of articles with a liquid coloring agent.

Referring first to FIG. 32, assembly 820 may be lowered into tank 804 filling with liquid coloring agent 805 using actuator 840. With first container 902 introduced into liquid coloring agent 805, an initial air pocket 1500 forms within first container 902. In this initial state, liquid coloring agent 805 is determined to have a fluid level 1510 with respect to first container 902. That is, in at least some cases, fluid level 1510 may be associated with a distance 1540 from the top surface of liquid coloring agent 805 to second end portion 917 of first container 902.

Determining the level of a liquid within a container can be accomplished using various methods. In some embodiments, pressure information determined from a pressure sensor (e.g., pressure sensor 1420 shown in FIG. 31) can be used to approximate the volume of air pocket 1500. In some cases, to best approximate the volume of air pocket 1500 using pressure information, other kinds of information may be required as well, including the temperature of air pocket 1500, an air density and/or mass density as well as possibly other kinds of information. Therefore, some embodiments could further incorporate additional kinds of sensors including temperature sensors and sensors for detecting mass and/or density characteristics of the air in an air pocket. Such sensors could be incorporated into fluid control system 1400 in some embodiments. With the volume of air pocket 1500 known, the approximate level of liquid can be calculated since the geometry of the container is known.

In other embodiments, the level of liquid within a container may be determined directly from a fluid level sensor. In some embodiments, for example, fluid level 1510 may be determined using fluid level sensor 1422 of fluid control system 1400. Fluid level sensor 1422 may be disposed within first container 902, as indicated schematically in FIG. 31. Thus, information from fluid level sensor 1422 may be used to approximately determine fluid level 1510. Based on the particular fluid level, the portions of plurality of articles 1200 that would be colored with liquid coloring agent 805 may be determined.

In some embodiments, the initial level of liquid coloring agent 805 within first container 902 may not be high enough to color a predetermined portion of each of plurality of articles 1200. Thus, in some embodiments, it may be desirable to adjust the level of liquid coloring agent 805 to ensure the desired portions of plurality of articles 1200 are fully colored.

As indicated in FIG. 33, fluid control system 1400 can be used to increase the level of liquid coloring agent 805 within first container 902. In particular, using various provisions of fluid control system 1400, air can be removed from first container 902 so that the volume of air pocket 1500 is reduced. In some embodiments, fluid pump 1402 (see FIG. 31) may be activated to pull air through first opening 970, thereby decreasing the volume of air within air pocket 1500. This results in a raised level of liquid coloring agent 805. Specifically, in FIG. 33, liquid coloring agent 805 is raised to a new fluid level 1512. At this point, a first portion 1520 of each of articles 1200 is disposed above liquid coloring agent 805, and thereby not colored, while a second portion 1522 of each of articles 1200 is immersed within liquid coloring agent 805 and colored.

It will of course be understood that as the volume of air pocket 1500 is decreased, the volume of liquid within interior region 915 of first container 902 is increased, thereby raising the fluid level of liquid coloring agent 805. In some embodiments, to achieve a desired fluid level of liquid within a container, a fluid control system may gradually pull air from a container while continuously monitoring the fluid level of liquid in the container (or some other parameter that can be used to deduce the fluid level, such as the air pressure). Once a desired fluid level for the liquid has been achieved, the fluid control system may stop pulling air from the container.

Although not shown in FIGS. 32-34, a similar process for adjusting the volume of air within second container 904 may be achieved using fluid control system 1400.

The result of this dyeing process creates partially dyed articles 1200 as shown in FIG. 34. Specifically, the uncolored first portions 1520 of articles 1200 and the colored second portions 1522 of articles 1200 may be clearly visible. This exemplary process shown in FIGS. 32-34 may be used to color a first portion (but not necessarily all) of an article, such as a sole. It will be understood that a similar process to that shown in FIGS. 32-34 may be utilized to color the remaining uncolored portions of articles 1200. Specifically, as shown in the process illustrated in FIGS. 5-9, an article may be inverted and then colored in an inverted position to achieve coloring over at least two different portions (for example, a forefoot portion and a heel portion). Thus, following the process of FIGS. 32-34, the uncolored portions may be colored by removing plurality of articles 1200 from first fastening assembly 980, inverting articles 1200 and fastening them back into first fastening assembly 980, thereby exposing the previously uncolored portions to a liquid coloring agent by repeating the dipping process discussed above.

The process described above is only intended to be one method of adjusting the level of liquid in a container after the container has been introduced into a liquid coloring agent. In an alternative embodiment, for example, fluid may be passively "pumped" from an interior region of a container using a vent (or valve) that can be controlled to automatically open and close.

Figure 35:
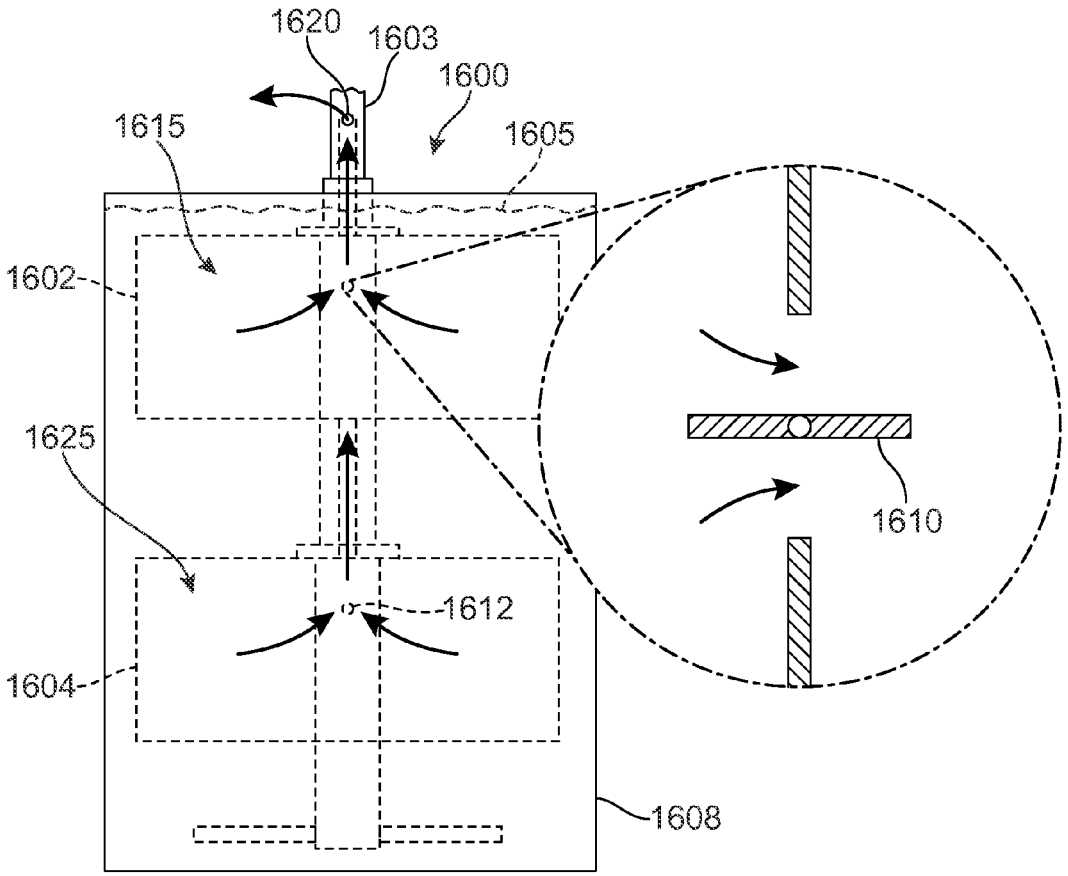
FIG. 35 is a schematic view of an embodiment of an assembly incorporating a vent, where the vent is in an open position.
Figure 36:
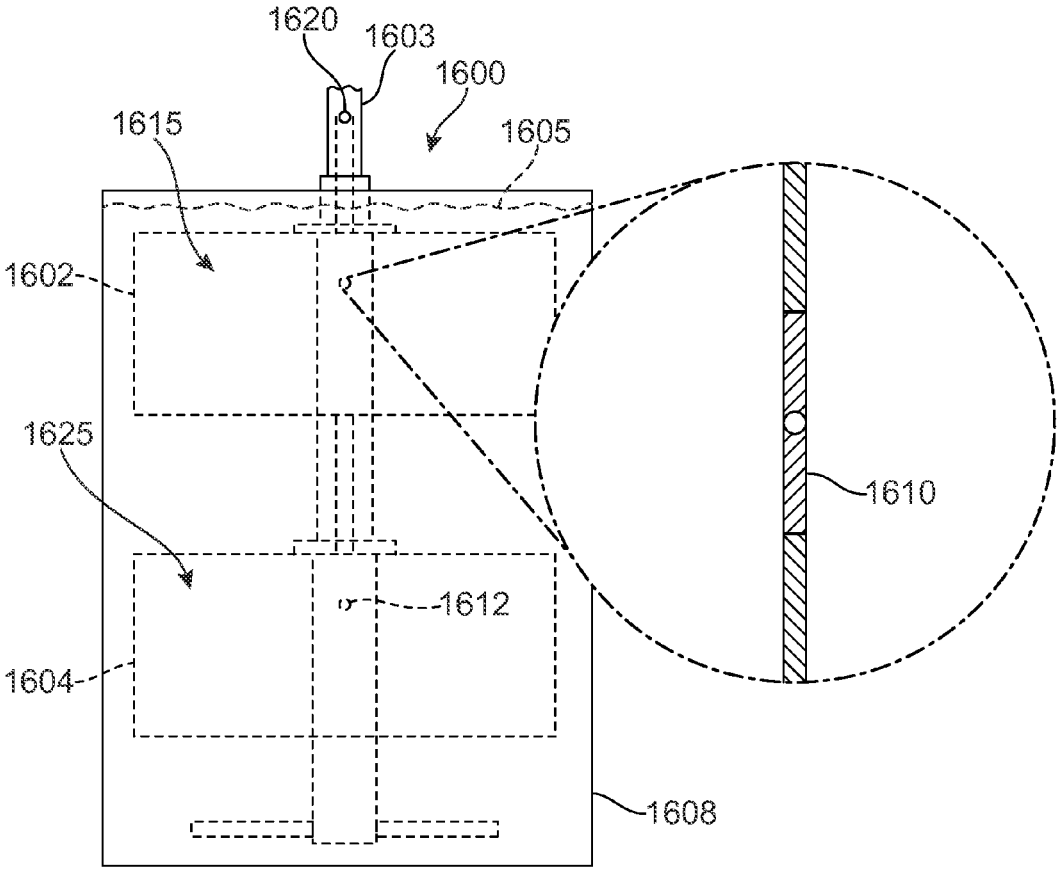
FIG. 36 is a schematic view of an embodiment of the assembly of FIG. 35, where the vent is in a closed position.

As an example of such an alternative embodiment, FIGS. 35 and 36 depict schematic views of an embodiment of an assembly 1600 including a first container 1602 and a second container 1604, which have been immersed in a tank 1608 of liquid coloring agent 1605. First container 1602 further includes a vent 1610 while second container 1604 includes a vent 1612. Moreover, vent 1610 provides fluid communication between an interior 1615 of first container 1602 and an opening 1620 in central support member 1603 of assembly 1600. Likewise, vent 1612 provides communication between an interior 1625 of second container 1604 and opening 1620. For purposes of clarity, the operation of vent 1610 is discussed below, but vent 1612 may be configured to operate in a similar manner.

As seen in FIG. 35, when vent 1610 is in an open position, gas may escape through vent 1610 and out of opening 1620. In this case, the gas may be pushed out through the open vent 1610 as liquid coloring agent enters first container 1602 from below. In contrast, with vent 1610 in a closed position, as shown in FIG. 36, gas may not escape from first container 1602. Thus, in some cases, vent 1610 may be placed in the closed position when it has been determined that the liquid coloring agent has risen to a desired level within the container. In such an embodiment, air is not pulled by a pump, but instead pushed out of the container by the liquid entering through the bottom of the container.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. A coloring system for making a colored article, comprising: an assembly, the assembly further including:

a central support member;

a container including an interior bounded by a top wall defining a closed end of the container and a side wall extending from the top wall to an open end of the container disposed at an opposite end of the container than the top wall, the container being attached to the central support member;

at least one fastening structure configured to fasten an article within the container in a fixed position;

an actuator that connects to the central support member, the actuator being configured to introduce the assembly into a liquid coloring agent, wherein the open end of the container allows the liquid coloring agent to contact a first portion of the article, while suspending a second portion of the article above the liquid coloring agent within a volume of air trapped between the top wall, a portion of the side wall, and a surface of the liquid coloring agent; and wherein the actuator can rotate the assembly such that the article may rotate about a central axis of the assembly, the central axis extending through a center of the central support member.

2. The coloring system according to claim 1, wherein the actuator can rotate the assembly in a clockwise direction.

3. The coloring system according to claim 2, wherein the actuator can rotate the assembly in a counterclockwise direction.

4. The coloring system according to claim 1, wherein the fastening structure comprises at least one bar and a spring clip member, and wherein the article is retained using the spring clip member to press the article against the at least one bar.

5. The coloring system according to claim 1, wherein the container is a first container and wherein the assembly includes a second container, wherein the second container is substantially similar to the first container, and wherein the first container and the second container are both attached to the central support member.

6. The coloring system according to claim 1, wherein actuator can further be used to raise and lower the assembly along a direction parallel with the central axis of the central support member.

7. The coloring system according to claim 1, wherein a volume of the trapped volume of air can be adjusted by selectively removing air from the container when the container is at least partially filled with the liquid coloring agent.

8. The coloring system according to claim 1, wherein the central support member includes at least one opening, the at least one opening permitting removal of air from the trapped volume of air when the container is at least partially filled with the liquid coloring agent to increase the volume of the liquid coloring agent within the container.

9. The coloring system according to claim 8, wherein the at least one opening is associated with a vent that is movable between an open position and a closed position, the vent preventing air from escaping the trapped volume of air when in the closed position and permitting air to escape the trapped volume of air when in the open position.

10. The coloring system according to claim 9, further comprising a sensor associated with an interior region of the container, the vent being moved between the open position and the closed position in response to information from the sensor.

11. The coloring system according to claim 8, wherein the at least one opening of the central support member is in fluid communication with a fluid pump that is configured to remove air from the container when the fluid pump is activated.

12. A coloring system for making a colored article, comprising:

an assembly, the assembly further including:

a central support member, the central support member including at least one opening;

a container including an interior bounded by a top wall defining a closed end of the container and a side wall extending from the top wall to an open end of the container disposed at an opposite end of the container than the top wall, the container being attached to the central support member and wherein the at least one opening of the central support member is in fluid communication with the interior of the container;

at least one fastening structure configured to fasten an article within the container in a fixed position;

an actuator that connects to the central support member, the actuator being configured to introduce the assembly into a liquid coloring agent, wherein the open end of the container allows the liquid coloring agent to enter the container and trap an initial air pocket within the container between the top wall, a portion of the side wall, and a surface of the liquid coloring agent, and wherein the liquid coloring agent within the container contacts a first portion of the article, while suspending a second portion of the article above the liquid coloring agent, the second portion of the article being disposed in the initial air pocket; and wherein the at least one opening of the central support member is in fluid communication with the initial air pocket to allow air to flow out of the container in order to increase the volume of the liquid coloring agent within the interior of the container, thereby decreasing the volume of the initial air pocket, when the container is at least partially filled with the liquid coloring agent.

13. The coloring system according to claim 12, wherein the at least one opening of the central support member is in fluid communication with a fluid pump and wherein the fluid pump is configured to remove the air from the container when the fluid pump is activated.

14. The coloring system according to claim 13, wherein the assembly includes a sensor associated with the interior of the container, and wherein the fluid pump pulls air from the container in response to information from the sensor.

15. The coloring system according to claim 14, wherein the sensor is a pressure sensor.

16. The coloring system according to claim 14, wherein the sensor is a fluid level sensor.

17. The coloring system according to claim 12, wherein the at least one opening is associated with a vent, wherein the vent can be actuated between an open position and a closed position, and wherein placing the vent in the closed position seals the interior so that air cannot escape from the interior and wherein placing the vent in the open position allows air to escape from the interior.

18. The coloring system according to claim 17, wherein the assembly includes a sensor associated with the interior of the container, and wherein the vent is moved between the open position and the closed position in response to information from the sensor.

* * * * *